US008405587B2

(12) United States Patent
Nathan et al.

(10) Patent No.: US 8,405,587 B2
(45) Date of Patent: Mar. 26, 2013

(54) METHOD AND SYSTEM FOR PROGRAMMING AND DRIVING ACTIVE MATRIX LIGHT EMITTING DEVICE PIXEL HAVING A CONTROLLABLE SUPPLY VOLTAGE

(75) Inventors: Arokia Nathan, Cambridge (GB); Gholamreza Reza Chaji, Waterloo (CA); Peyman Servati, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 12/851,652

(22) Filed: Aug. 6, 2010

(65) Prior Publication Data

US 2011/0012883 A1 Jan. 20, 2011

Related U.S. Application Data

(63) Continuation of application No. 11/298,240, filed on Dec. 7, 2005, now Pat. No. 7,800,565.

(30) Foreign Application Priority Data

Dec. 7, 2004 (CA) ..... 2490858

(51) Int. Cl.
*G09G 3/32* (2006.01)

(52) U.S. Cl. ..... 345/82

(58) Field of Classification Search ..... 345/77–78, 345/82–83, 211
See application file for complete search history.

(56) References Cited

U.S. PATENT DOCUMENTS

| | | | |
|---|---|---|---|
| 4,996,523 | A | 2/1991 | Bell et al. |
| 5,266,515 | A | 11/1993 | Robb et al. |
| 5,498,880 | A | 3/1996 | Lee et al. |
| 5,619,033 | A | 4/1997 | Weisfield |
| 5,648,276 | A | 7/1997 | Hara et al. |
| 5,714,968 | A | 2/1998 | Ikeda |
| 5,748,160 | A | 5/1998 | Shieh et al. |
| 5,874,803 | A | 2/1999 | Garbuzov et al. |
| 5,880,582 | A | 3/1999 | Sawada |
| 5,903,248 | A | 5/1999 | Irwin |
| 5,917,280 | A | 6/1999 | Burrows et al. |
| 5,952,789 | A | 9/1999 | Stewart et al. |
| 5,990,629 | A | 11/1999 | Yamada et al. |
| 6,023,259 | A | 2/2000 | Howard et al. |

(Continued)

FOREIGN PATENT DOCUMENTS

| | | |
|---|---|---|
| CA | 2249592 | 7/1998 |
| CA | 2368386 | 9/1999 |

(Continued)

OTHER PUBLICATIONS

Ahnood et al.: "Effect of threshold voltage instability on field effect mobility in thin film transistors deduced from constant current measurements"; dated Aug. 2009.

(Continued)

*Primary Examiner* — Chanh Nguyen
*Assistant Examiner* — Long D Pham
(74) *Attorney, Agent, or Firm* — Nixon Peabody LLP

(57) ABSTRACT

Method and system for programming and driving active matrix light emitting device pixel is provided. The pixel is a voltage programmed pixel circuit, and has a light emitting device, a driving transistor and a storage capacitor. The pixel has a programming cycle having a plurality of operating cycles, and a driving cycle. During the programming cycle, the voltage of the connection between the OLED and the driving transistor is controlled so that the desired gate-source voltage of a driving transistor is stored in a storage capacitor.

17 Claims, 22 Drawing Sheets

U.S. PATENT DOCUMENTS

| | | | | |
|---|---|---|---|---|
| 6,069,365 | A | 5/2000 | Chow et al. | |
| 6,091,203 | A | 7/2000 | Kawashima et al. | |
| 6,097,360 | A | 8/2000 | Holloman | |
| 6,144,222 | A | 11/2000 | Ho | |
| 6,229,508 | B1 | 5/2001 | Kane | |
| 6,246,180 | B1 | 6/2001 | Nishigaki | |
| 6,252,248 | B1 | 6/2001 | Sano et al. | |
| 6,288,696 | B1 | 9/2001 | Holloman | |
| 6,307,322 | B1 | 10/2001 | Dawson et al. | |
| 6,323,631 | B1 | 11/2001 | Juang | |
| 6,392,617 | B1 | 5/2002 | Gleason | |
| 6,433,488 | B1 | 8/2002 | Bu | |
| 6,501,466 | B1 | 12/2002 | Yamagishi et al. | |
| 6,580,408 | B1 | 6/2003 | Bae et al. | |
| 6,693,610 | B2 | 2/2004 | Shannon et al. | |
| 6,697,057 | B2 | 2/2004 | Koyama et al. | |
| 6,734,636 | B2 | 5/2004 | Sanford et al. | |
| 6,859,193 | B1 | 2/2005 | Yumoto | |
| 6,919,871 | B2 | 7/2005 | Kwon | |
| 6,940,214 | B1 | 9/2005 | Komiya et al. | |
| 7,129,914 | B2 | 10/2006 | Knapp et al. | |
| 7,248,236 | B2 | 7/2007 | Nathan et al. | |
| 7,310,092 | B2 | 12/2007 | Forrest et al. | |
| 2001/0002703 | A1 | 6/2001 | Koyama | |
| 2001/0026257 | A1 | 10/2001 | Kimura | |
| 2001/0030323 | A1 | 10/2001 | Ikeda | |
| 2001/0043173 | A1 | 11/2001 | Troutman | |
| 2001/0045929 | A1 | 11/2001 | Prache | |
| 2002/0000576 | A1 | 1/2002 | Inukai | |
| 2002/0011796 | A1 | 1/2002 | Koyama | |
| 2002/0011799 | A1 | 1/2002 | Kimura | |
| 2002/0195968 | A1* | 12/2002 | Sanford et al. | 315/169.3 |
| 2003/0062524 | A1 | 4/2003 | Kimura | |
| 2003/0090481 | A1 | 5/2003 | Kimura | |
| 2003/0095087 | A1* | 5/2003 | Libsch et al. | 345/82 |
| 2003/0107560 | A1 | 6/2003 | Yumoto et al. | |
| 2003/0111966 | A1 | 6/2003 | Mikami et al. | |
| 2003/0197663 | A1 | 10/2003 | Lee et al. | |
| 2003/0230980 | A1 | 12/2003 | Forrest et al. | |
| 2004/0070557 | A1 | 4/2004 | Asano et al. | |
| 2004/0145547 | A1 | 7/2004 | Oh | |
| 2004/0150595 | A1* | 8/2004 | Kasai | 345/82 |
| 2004/0155841 | A1 | 8/2004 | Kasai | |
| 2004/0174349 | A1 | 9/2004 | Libsch et al. | 345/204 |
| 2004/0196275 | A1 | 10/2004 | Hattori | |
| 2004/0252089 | A1 | 12/2004 | Ono et al. | |
| 2005/0007357 | A1 | 1/2005 | Yamashita et al. | |
| 2005/0067971 | A1 | 3/2005 | Kane | |
| 2005/0206590 | A1 | 9/2005 | Sasaki et al. | 345/76 |
| 2005/0285825 | A1 | 12/2005 | Eom et al. | |
| 2006/0261841 | A1 | 11/2006 | Fish | |

FOREIGN PATENT DOCUMENTS

| | | | |
|---|---|---|---|
| CA | 2242720 | | 1/2000 |
| CA | 2354018 | | 6/2000 |
| CA | 2436451 | | 8/2002 |
| CA | 2463653 | | 1/2004 |
| CA | 2438363 | | 2/2005 |
| CA | 2526782 | C | 8/2007 |
| EP | 1 028 471 | A | 8/2000 |
| EP | 1 130 565 | A1 | 9/2001 |
| EP | 1 429 312 | A | 6/2004 |
| EP | 1 439 520 | A2 | 7/2004 |
| EP | 1 465 143 | A | 10/2004 |
| EP | 1 517 290 | A2 | 3/2005 |
| JP | 09 090405 | | 4/1997 |
| JP | 11 231805 | | 8/1999 |
| JP | 2003-271095 | | 9/2003 |
| WO | 02/067327 | A | 8/2002 |
| WO | 2006/053424 | | 5/2006 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High- Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
European Search Report for European Application No. EP 05 82 1114 dated Mar. 27, 2009 (2 pages).
International Search Report for International Application No. PCT/CA2005/001844 dated Mar. 28, 2006 (2 pages).
Ma e y et al: "Organic Light-Emitting Diode/Thin Film Transistor Integration for foldable Displays" Conference record of the 1997 International display research conference and international workshops on LCD technology and emissive technology. Toronto, Sep. 15-19, 1997 (6 pages).

Matsueda y et al.: "35.1: 2.5-in. AMOLED with Integrated 6-bit Gamma Compensated Digital Data Driver"; dated May 2004 (4 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Thin film imaging technology on glass and plastic"; dated Oct. 31-Nov. 2, 2000 (4 pages).
Philipp: "Charge transfer sensing" SENSOR REVIEW, vol. 19, No. 2, Dec. 31, 1999, 10 pages.
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Wang et al.: "Indium oxides by reactive ion beam assisted evaporation: From material study to device application"; dated Mar. 2009 (6 pages).
Chaji et al.: "Pseudo dynamic logic (SDL): a high-speed and low-power dynamic logic family": dated Aug. 7, 2002 (4 pages).
Chaji et al.: "Thin-Film Transistor Integration for Biomedical Imaging and AMOLED Displays"; dated May 2008 (177 pages).
Jafarabadiashtiani et al.: "A New Driving Method for a-Si AMOLED Displays Based on Voltage Feedback"; dated May 2005 (4 pages).
Lee et al.: "Ambipolar Thin-Film Transistors Fabricated by PECVD Nanocrystalline Silicon"; dated Apr. 2006 (6 pages).
Nathan et al.: "Backplane Requirements for Active Matrix Organic Light Emitting Diode Displays"; dated Apr. 2006 (16 pages).
Nathan et al.: "Invited Paper: a -Si for AMOLED—Meeting the Performance and Cost Demands of Display Applications (Cell Phone to HDTV)"; dated Jun. 2006 (4 pages).
Rafati et al.: "Comparison of a 17 b multiplier in Dual-rail domino and in Dual-rail D L (D L) logic styles"; dated Aug. 7, 2002 (4 pages).
Stewart M. et al., "Polysilicon TFT technology for active matrix OLED displays" IEEE transactions on electron devices, vol. 48, No. 5; dated May 2001 (7 pages).
Vygranenko et al.: "Stability of indium-oxide thin-film transistors by reactive ion beam assisted deposition"; dated Oct. 1, 2009.
Extended European Search Report mailed Nov. 8, 2011 issued in corresponding European Patent Application No. 11175223.4 (8 pages).

* cited by examiner

Top emission pixels

Bottom emission pixels

METHOD AND SYSTEM FOR PROGRAMMING AND DRIVING ACTIVE MATRIX LIGHT EMITTING DEVICE PIXEL HAVING A CONTROLLABLE SUPPLY VOLTAGE

CROSS REFERENCE TO RELATED APPLICATIONS

This application is a continuation of U.S. patent application Ser. No. 11/298,240, filed Dec. 7, 2005, which claims priority to Canadian Patent No. 2,490,858, filed Dec. 7, 2004, each of which is incorporated herein by reference in its entirety.

FIELD OF INVENTION

The present invention relates to a light emitting device displays, and more specifically to a driving technique for the light emitting device displays.

BACKGROUND OF THE INVENTION

Recently active-matrix organic light-emitting diode (AMOLED) displays with amorphous silicon (a-Si), polysilicon, organic, or other driving backplane have become more attractive due to advantages over active matrix liquid crystal displays. An AMOLED display using a-Si backplanes, for example, has the advantages which include low temperature fabrication that broadens the use of different substrates and makes flexible displays feasible, and its low cost fabrication that yields high resolution displays with a wide viewing angle.

The AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current.

FIG. 1 shows a pixel circuit as disclosed in U.S. Pat. No. 5,748,160. The pixel circuit of FIG. 1 includes an OLED 10, a driving thin film transistor (TFT) 11, a switch TFT 13, and a storage capacitor 14. The drain terminal of the driving TFT 11 is connected to the OLED 10. The gate terminal of the driving TFT 11 is connected to a column line 12 through the switch TFT 13. The storage capacitor 14, which is connected between the gate terminal of the driving TFT 11 and the ground, is used to maintain the voltage at the gate terminal of the driving TFT 11 when the pixel circuit is disconnected from the column line 12. The current through the OLED 10 strongly depends on the characteristic parameters of the driving TFT 11. Since the characteristic parameters of the driving TFT 11, in particular the threshold voltage under bias stress, vary by time, and such changes may differ from pixel to pixel, the induced image distortion may be unacceptably high.

U.S. Pat. No. 6,229,508 discloses a voltage-programmed pixel circuit which provides, to an OLED, a current independent of the threshold voltage of a driving TFT. In this pixel, the gate-source voltage of the driving TFT is composed of a programming voltage and the threshold voltage of the driving TFT. A drawback of U.S. Pat. No. 6,229,508 is that the pixel circuit requires extra transistors, and is complex, which results in a reduced yield, reduced pixel aperture, and reduced lifetime for the display.

Another method to make a pixel circuit less sensitive to a shift in the threshold voltage of the driving transistor is to use current programmed pixel circuits, such as pixel circuits disclosed in U.S. Pat. No. 6,734,636. In the conventional current programmed pixel circuits, the gate-source voltage of the driving TFT is self-adjusted based on the current that flows through it in the next frame, so that the OLED current is less dependent on the current-voltage characteristics of the driving TFT. A drawback of the current-programmed pixel circuit is that an overhead associated with low programming current levels arises from the column line charging time due to the large line capacitance.

SUMMARY OF THE INVENTION

It is an object of the invention to provide a method and system that obviates or mitigates at least one of the disadvantages of existing systems.

In accordance with an aspect to the present invention there is provided a method of programming and driving a display system, the display system includes: a display array having a plurality of pixel circuits arranged in row and column, each pixel circuit having: a light emitting device having a first terminal and a second terminal, the first terminal of the lighting device being connected to a voltage supply electrode; a capacitor having a first terminal and a second terminal; a switch transistor having a gate terminal, a first terminal and a second terminal, the gate terminal of the switch transistor being connected to a select line, the first terminal of the switch transistor being connected to a signal line for transferring voltage data, the second terminal of the switch transistor being connected to the first terminal of the capacitor; and a driving transistor having a gate terminal, a first terminal and a second terminal, the gate terminal of the driving transistor being connected to the second terminal of the switch transistor and the first terminal of the capacitor at a first node (A), the first terminal of the driving transistor being connected to the second terminal of the light emitting device and the second terminal of the capacitor at a second node (B), the second terminal of the driving transistor being connected to a controllable voltage supply line; a driver for driving the select line, the controllable voltage supply line and the signal line to operate the display array; the method including the steps of: at a programming cycle, at a first operating cycle, charging the second node at a first voltage defined by (VREF-VT) or (−VREF+VT), where VREF represents a reference voltage and VT represents a threshold voltage of the driving transistor; at a second operating cycle, charging the first node at a second voltage defined by (VREF+VP) or (−VREF+VP) so that the difference between the first and second node voltages is stored in the storage capacitor, where VP represents a programming voltage; at a driving cycle, applying the voltage stored in the storage capacitor to the gate terminal of the driving transistor.

In accordance with a further aspect to the present invention there is provided a method of programming and driving a display system, the display system includes: a display array having a plurality of pixel circuits arranged in row and column, each pixel circuit having: a light emitting device having a first terminal and a second terminal, the first terminal of the lighting device being connected to a voltage supply electrode; a first capacitor and a second capacitor, each having a first terminal and a second terminal; a first switch transistor having a gate terminal, a first terminal and a second terminal, the gate terminal of the first switch transistor being connected to a first select line, the first terminal of the first switch transistor being connected to the second terminal of the light emitting device, the second terminal of the first switch being connected to the first terminal of the first capacitor; a second switch transistor having a gate terminal, a first terminal and a second terminal, the gate terminal of the second switch transistor being connected to a second select line, the first terminal of the second switch transistor being connected to a signal line for transferring voltage data; a driving transistor having a gate terminal, a first terminal and a second terminal, the first terminal of the driving transistor being connected to the second terminal of the light emitting device at a first node (A), the gate terminal of the driving transistor being connected to the second terminal of the first switch transistor and the first terminal of the first capacitor at a second node (B), the second terminal of the driving transistor being connected to a controllable voltage supply line; the second terminal of the second switch transistor being connected to the second terminal of the first capacitor and the first terminal of the second capacitor at a third node (C); a driver for driving the first and second select line, the controllable voltage supply line and the signal line to operate the display array, the method including the steps of: at a programming cycle, at a first operating cycle, controlling the voltage of each of the first node and the second node so as to store (VT+VP) or −(VT+VP) in the first storage capacitor, where VT represents a threshold voltage of the driving transistor, VP represents a programming voltage; at a second operating cycle, discharging the third node; at a driving cycle, applying the voltage stored in the storage capacitor to the gate terminal of the driving transistor.

In accordance with a further aspect to the present invention there is provided a display system including: a display array having a plurality of pixel circuits arranged in row and column, each pixel circuit having: a light emitting device having a first terminal and a second terminal, the first terminal of the lighting device being connected to a voltage supply electrode; a capacitor having a first terminal and a second terminal; a switch transistor having a gate terminal, a first terminal and a second terminal, the gate terminal of the switch transistor being connected to a select line, the first terminal of the switch transistor being connected to a signal line for transferring voltage data, the second terminal of the switch transistor being connected to the first terminal of the capacitor; and a driving transistor having a gate terminal, a first terminal and a second terminal, the gate terminal of the driving transistor being connected to the second terminal of the switch transistor and the first terminal of the capacitor at a first node (A), the first terminal of the driving transistor being connected to the second terminal of the light emitting device and the second terminal of the capacitor at a second node (B), the second terminal of the driving transistor being connected to a controllable voltage supply line; a driver for driving the select line, the controllable voltage supply line and the signal line to operate the display array; and a controller for implementing a programming cycle and a driving cycle on each row of the display array using the driver; wherein the programming cycle includes a first operating cycle and a second operating cycle, wherein at the first operating cycle, the second node is charged at a first voltage defined by (VREF−VT) or (−VREF+VT), where VREF represents a reference voltage and VT represents a threshold voltage of the driving transistor, at the second operating cycle, the first node is charged at a second voltage defined by (VREF+VP) or (−VREF+VP) so that the difference between the first and second node voltages is stored in the storage capacitor, where VP represents a programming voltage; wherein at the driving cycle, the voltage stored in the storage capacitor is applied to the gate terminal of the driving transistor.

In accordance with a further aspect to the present invention there is provided a display system including: a display array having a plurality of pixel circuits arranged in row and column, each pixel circuit having: a light emitting device having a first terminal and a second terminal, the first terminal of the lighting device being connected to a voltage supply electrode; a first capacitor and a second capacitor, each having a first terminal and a second terminal; a first switch transistor having a gate terminal, a first terminal and a second terminal, the gate terminal of the first switch transistor being connected to a first select line, the first terminal of the first switch transistor being connected to the second terminal of the light emitting device, the second terminal of the first switch being connected to the first terminal of the first capacitor; a second switch transistor having a gate terminal, a first terminal and a second terminal, the gate terminal of the second switch transistor being connected to a second select line, the first terminal of the second switch transistor being connected to a signal line for transferring voltage data; a driving transistor having a gate terminal, a first terminal and a second terminal, the first terminal of the driving transistor being connected to the second terminal of the light emitting device at a first node (A), the gate terminal of the driving transistor being connected to the second terminal of the first switch transistor and the first terminal of the first capacitor at a second node (B), the second terminal of the driving transistor being connected to a controllable voltage supply line; the second terminal of the second switch transistor being connected to the second terminal of the first capacitor and the first terminal of the second capacitor at a third node (C); a driver for driving the first and second select line, the controllable voltage supply line and the signal line to operate the display array; and a controller for implementing a programming cycle and a driving cycle on each row of the display array using the driver; wherein the programming cycle includes a first operating cycle and a second operating cycle, wherein at the first operating cycle, the voltage of each of the first node and the second node is controlled so as to store (VT+VP) or −(VT+VP) in the first storage capacitor, where VT represents a threshold voltage of the driving transistor, VP represents a programming voltage, at the second operating cycle, the third node is discharged, wherein at the driving cycle, the voltage stored in the storage capacitor is applied to the gate terminal of the driving transistor.

This summary of the invention does not necessarily describe all features of the invention.

Other aspects and features of the present invention will be readily apparent to those skilled in the art from a review of the following detailed description of preferred embodiments in conjunction with the accompanying drawings.

BRIEF DESCRIPTION OF THE DRAWINGS

These and other features of the invention will become more apparent from the following description in which reference is made to the appended drawings wherein:

FIG. 7(*b*) is a diagram showing an example of the array structure having bottom emission pixels which are applicable to the array of FIG. 6;

DETAILED DESCRIPTION OF THE PREFERRED EMBODIMENTS OF THE INVENTION

Embodiments of the present invention are described using a pixel having an organic light emitting diode (OLED) and a driving thin film transistor (TFT). However, the pixel may include any light emitting device other than OLED, and the pixel may include any driving transistor other than TFT. It is noted that in the description, "pixel circuit" and "pixel" may be used interchangeably.

Figure 1:
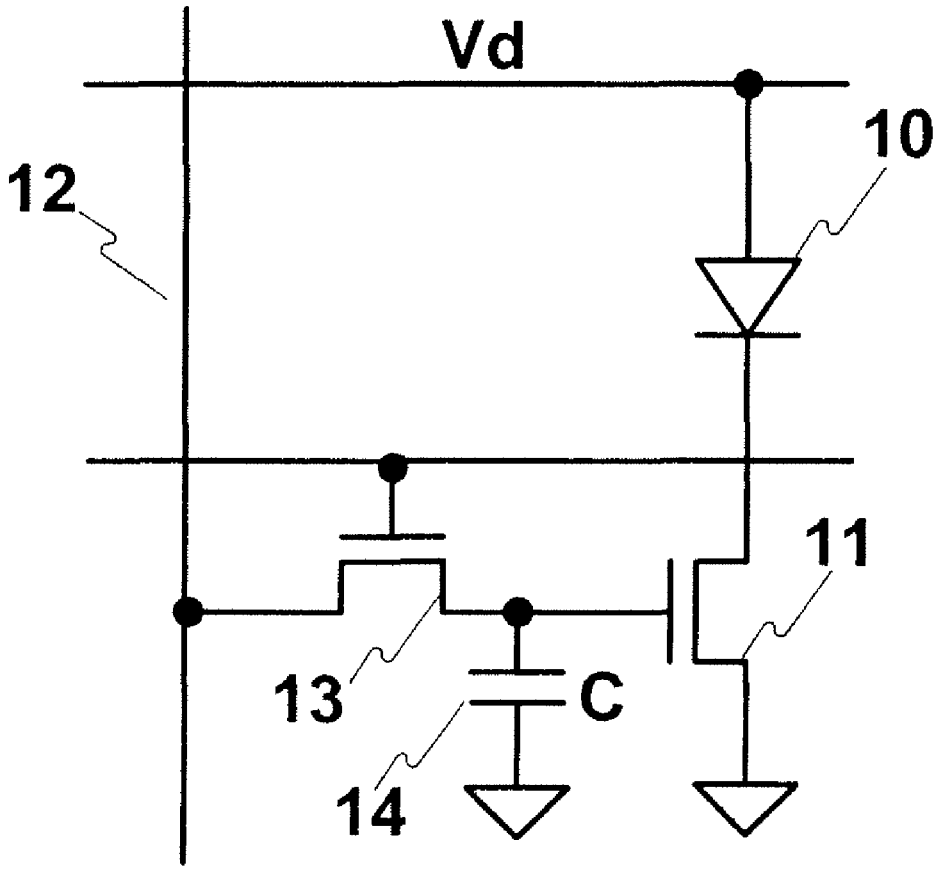
Figure 1 Prior Art
FIG. 1 is a diagram showing a conventional 2-TFT voltage programmed pixel circuit.
Figure 2:
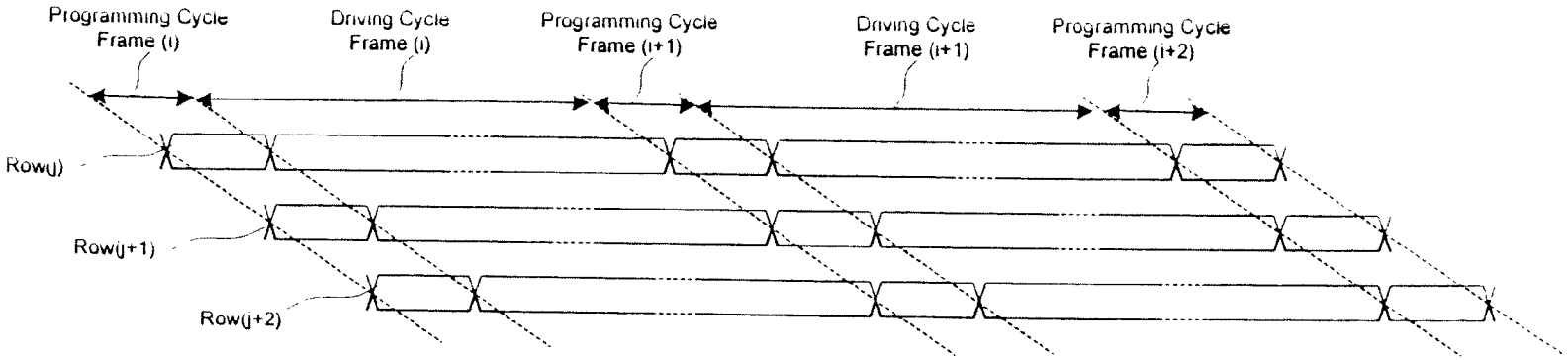
FIG. 2 is a timing diagram showing an example of programming and driving cycles in accordance with an embodiment of the present invention, which is applied to a display array.

FIG. 2 is a diagram showing programming and driving cycles in accordance with an embodiment of the present invention. In FIG. 2, each of ROW(j), ROW(j+1), and ROW (j+2) represents a row of the display array where a plurality of pixel circuits are arranged in row and column.

The programming and driving cycle for a frame occurs after the programming and driving cycle for a next frame. The programming and driving cycles for the frame at a ROW overlaps with the programming and driving cycles for the same frame at a next ROW. As described below, during the programming cycle, the time depending parameter(s) of the pixel circuit is extracted to generate a stable pixel current.

Figure 3:
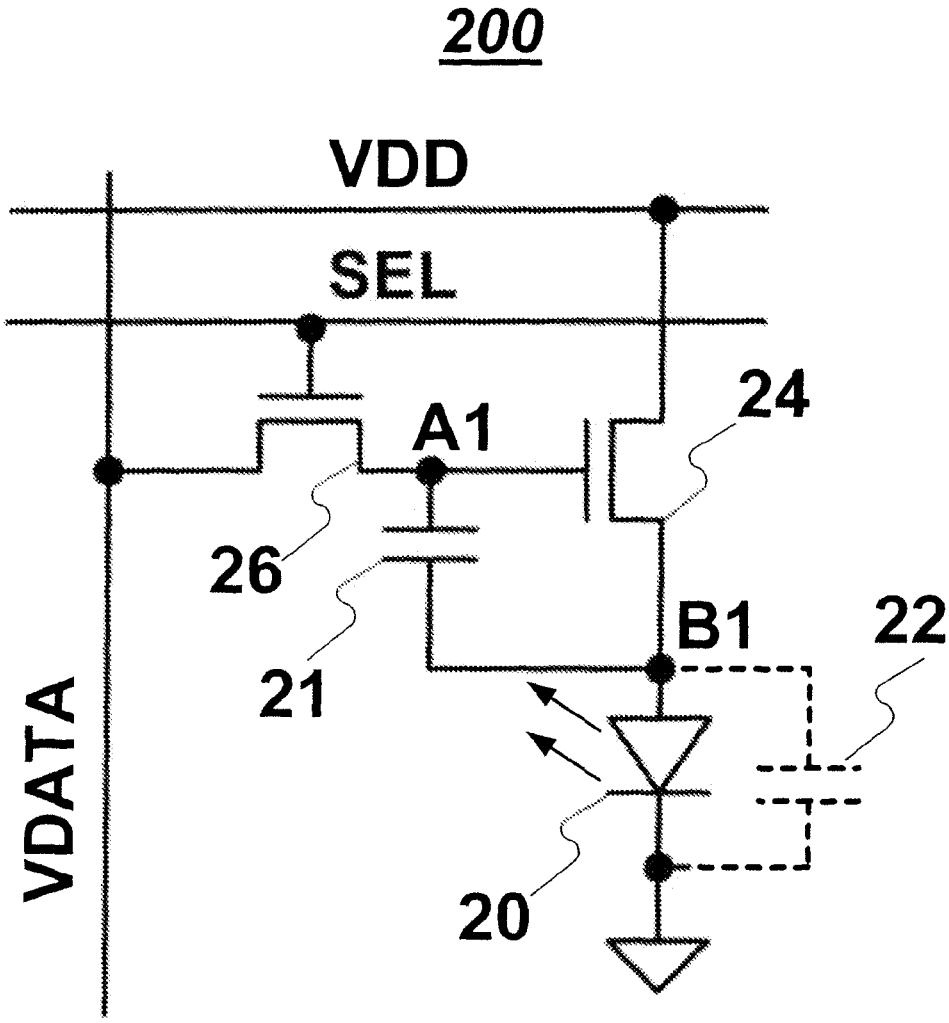
FIG. 3 is a diagram showing a pixel circuit to which programming and driving technique in accordance with an embodiment of the present invention is applied.

FIG. 3 illustrates a pixel circuit 200 to which programming and driving technique in accordance with an embodiment of the present invention is applied. The pixel circuit 200 includes an OLED 20, a storage capacitor 21, a driving transistor 24, and a switch transistor 26. The pixel circuit 200 is a voltage programmed pixel circuit. Each of the transistors 24 and 26 has a gate terminal, a first terminal and a second terminal. In the description, the first terminal (second terminal) may be, but not limited to, a drain terminal or a source terminal (a source terminal or a drain terminal).

Figure 14:
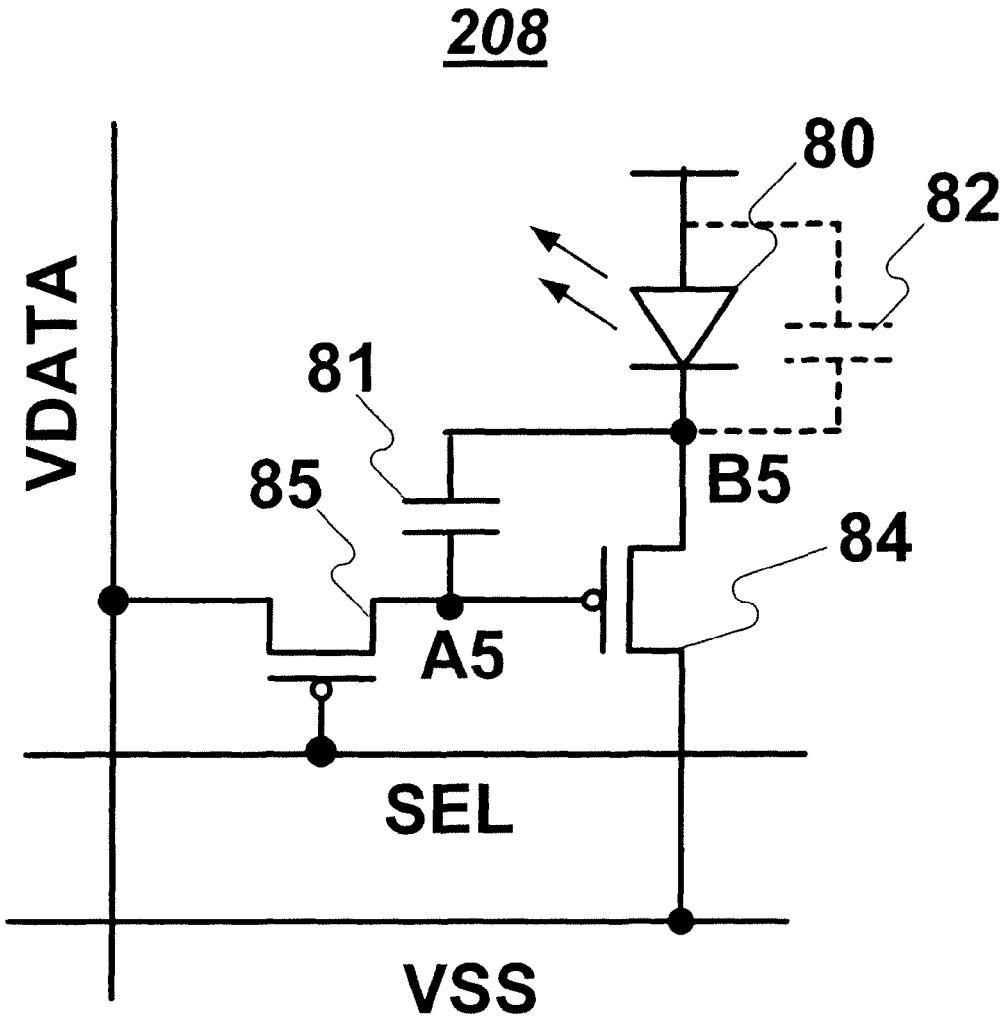
FIG. 14 is a diagram showing a pixel circuit to which programming and driving technique in accordance with a further embodiment of the present invention is applied.

The transistors 24 and 26 are n-type TFTs. However, the transistors 24 and 26 may be p-type transistors. As described below, the driving technique applied to the pixel circuit 200 is also applicable to a complementary pixel circuit having p-type transistors as shown in FIG. 14. The transistors 24 and 26 may be fabricated using amorphous silicon, nano/micro crystalline silicon, poly silicon, organic semiconductors technologies (e.g. organic TFT), NMOS/PMOS technology or CMOS technology (e.g. MOSFET).

The first terminal of the driving transistor 24 is connected to a controllable voltage supply line VDD. The second terminal of the driving transistor 24 is connected to the anode electrode of the OLED 20. The gate terminal of the driving transistor 24 is connected to a signal line VDATA through the switch transistor 26. The storage capacitor 21 is connected between the source and gate terminals of the driving transistor 24.

The gate terminal of the switch transistor 26 is connected to a select line SEL. The first terminal of the switch transistor 26 is connected to the signal line VDATA. The second terminal of the switch transistor 26 is connected to the gate terminal of the driving transistor 24. The cathode electrode of the OLED 20 is connected to a ground voltage supply electrode.

The transistors 24 and 26 and the storage capacitor 21 are connected at node A1. The transistor 24, the OLED 20 and the storage capacitor 21 are connected at node B1.

Figure 4:
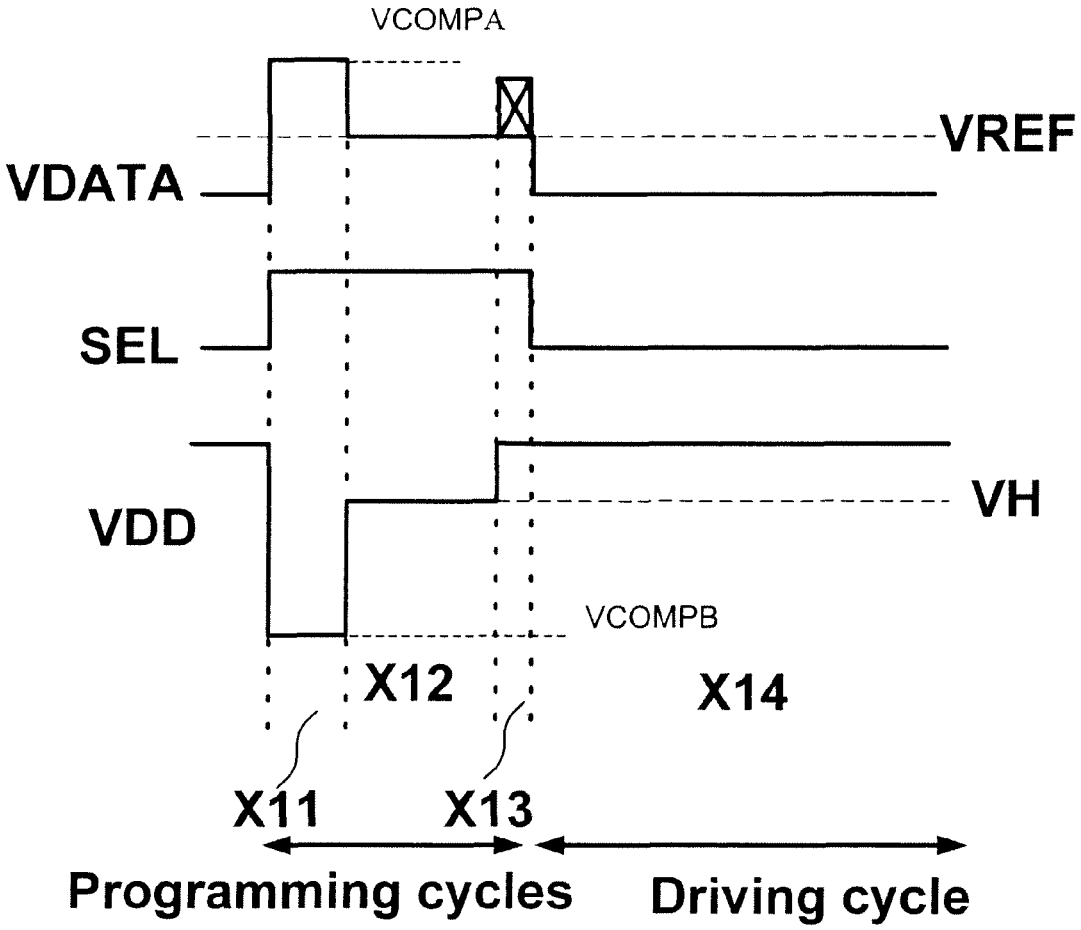
FIG. 4 is a timing diagram showing an example of waveforms for programming and driving the pixel circuit of FIG. 3.

FIG. 4 illustrates a timing diagram showing an example of waveforms for programming and driving the pixel circuit 200 of FIG. 3. Referring to FIGS. 3 and 4, the operation of the pixel circuit 200 includes a programming cycle having three operating cycles X11, X12 and X13, and a driving cycle having one operating cycle X14.

During the programming cycle, node B1 is charged to the negative threshold voltage of the driving transistor 24, and node A1 is charged to a programming voltage VP.

As a result, the gate-source voltage of the driving transistor 24 goes to:

$$VGS=VP-(-VT)=VP+VT \quad (1)$$

where VGS represents the gate-source voltage of the driving transistor 24, and VT represents the threshold voltage of the driving transistor 24.

Since the driving transistor 24 is in saturation regime of operation, its current is defined mainly by its gate-source voltage. As a result the current of the driving transistor 24 remains constant even if the OLED voltage changes, since its gate-source voltage is stored in the storage capacitor 21.

In the first operating cycle X11: VDD goes to a compensating voltage VCOMPB, and VDATA goes to a high positive compensating voltage VCOMPA, and SEL is high. As a result, node A1 is charged to VCOMPA and node B1 is charged to VCOMPB.

In the second operating cycle X12: While VDATA goes to a reference voltage VREF, node B1 is discharged through the driving transistor 24 until the driving transistor 24 turns off. As a result, the voltage of node B1 reaches (VREF-VT). VDD has a positive voltage VH to increase the speed of this cycle X12. For optimal setting time, VH can be set to be equal to the operating voltage which is the voltage on VDD during the driving cycle.

In the third operating cycle X13: VDD goes to its operating voltage. While SEL is high, node A1 is charged to (VP+VREF). Because the capacitance 22 of the OLED 20 is large, the voltage at node B1 stays at the voltage generated in the previous cycle X12. Thus, the voltage of node B1 is (VREF−VT). Therefore, the gate-source voltage of the driving transistor 24 is (VP+VT), and this gate-source voltage is stored in the storage capacitor 21.

In the fourth operating cycle X14: SEL and VDATA go to zero. VDD is the same as that of the third operating cycle X13. However, VDD may be higher than that of the third operating cycle X13. The voltage stored in the storage capacitor 21 is applied to the gate terminal of the driving transistor 24. Since the gate-source voltage of the driving transistor 24 include its threshold voltage and also is independent of the OLED voltage, the degradation of the OLED 20 and instability of the driving transistor 24 does not affect the amount of current flowing through the driving transistor 24 and the OLED 20.

It is noted that the pixel circuit 200 can be operated with different values of VCOMPB, VCOMPA, VP, VREF and VH. VCOMPB, VCOMPA, VP, VREF and VH define the lifetime of the pixel circuit 200. Thus, these voltages can be defined in accordance with the pixel specifications.

Figure 5:
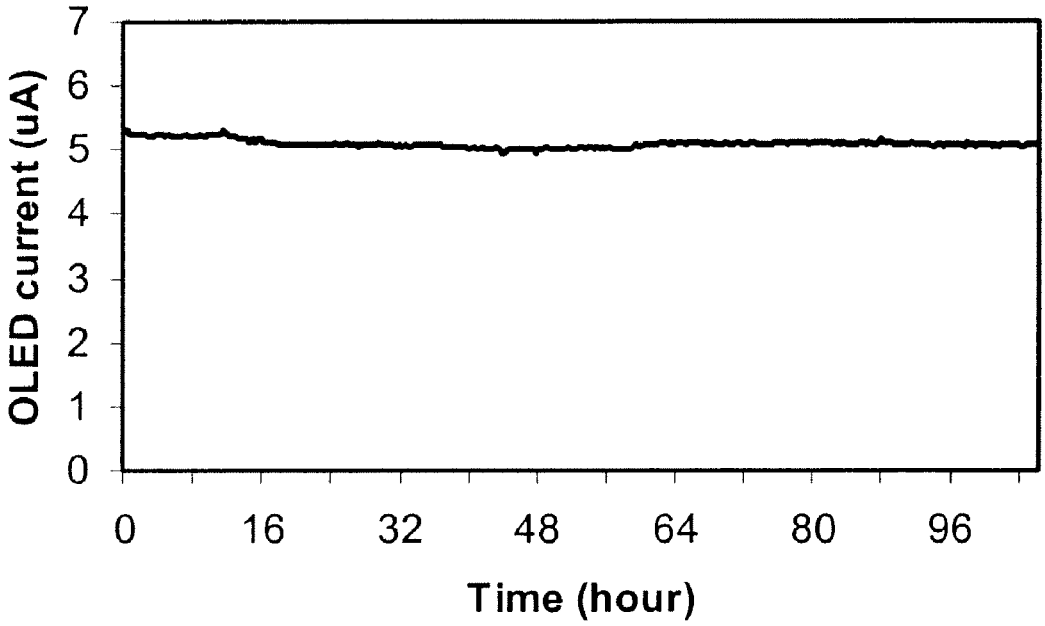
FIG. 5 is a diagram showing a lifetime test result for the pixel circuit of FIG. 3.

FIG. 5 illustrates a lifetime test result for the pixel circuit and waveform shown in FIGS. 3 and 4. In the test, a fabricated pixel circuit was put under the operation for a long time while the current of the driving transistor (24 of FIG. 3) was monitored to investigate the stability of the driving scheme. The result shows that OLED current is stable after 120-hour operation. The VT shift of the driving transistor is 0.7 V.

Figure 6:
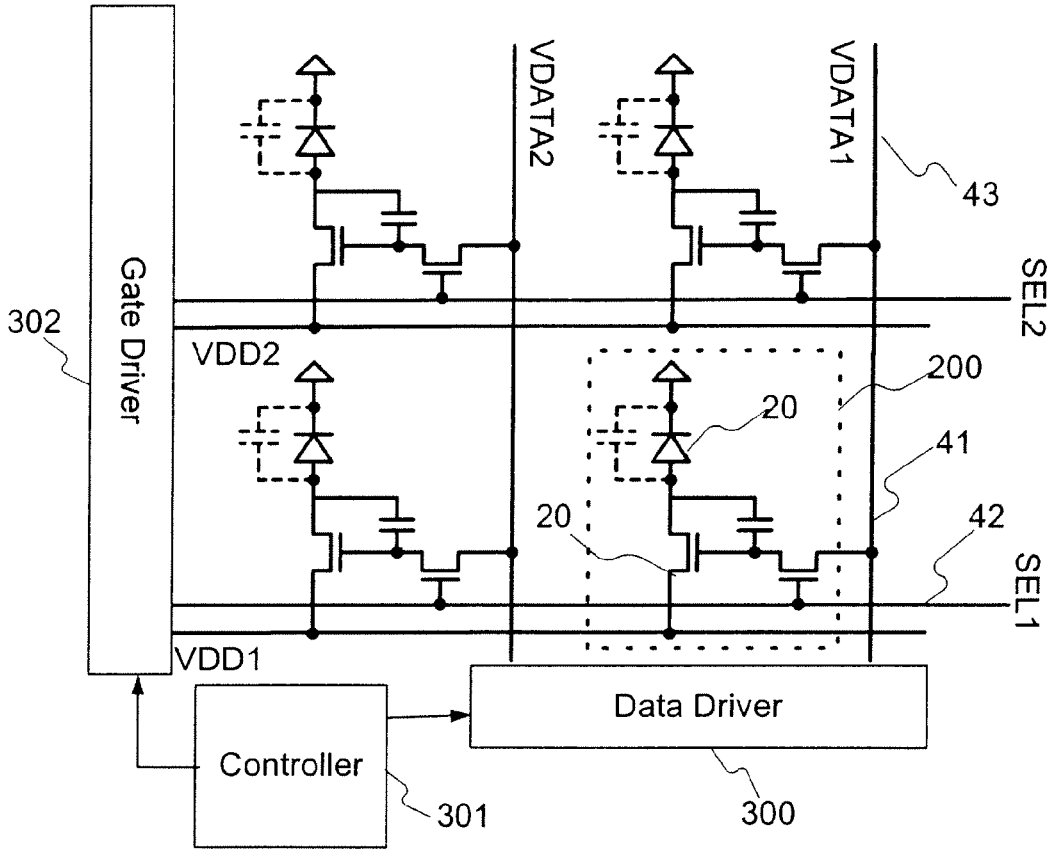
FIG. 6 is a diagram showing a display system having the pixel circuit of FIG. 3.

FIG. 6 illustrates a display system having the pixel circuit 200 of FIG. 3. VDD1 and VDD2 of FIG. 6 correspond to VDD of FIG. 3. SEL1 and SEL2 of FIG. 6 correspond to SEL of FIG. 3. VDATA1 and VDATA2 of FIG. 6 correspond to VDATA of FIG. 3. The array of FIG. 6 is an active matrix light emitting diode (AMOLED) display having a plurality of the pixel circuits 200 of FIG. 3. The pixel circuits are arranged in rows and columns, and interconnections 41, 42 and 43 (VDATA1, SEL1, VDD1). VDATA1 (or VDATA 2) is shared between the common column pixels while SEL1 (or SEL2) and VDD1 (or VDD2) are shared between common row pixels in the array structure.

A driver 300 is provided for driving VDATA1 and VDATA2. A driver 302 is provided for driving VDD1, VDD2, SEL1 and SEL 2, however, the driver for VDD and SEL lines can also be implemented separately. A controller 304 controls the drivers 300 and 302 to programming and driving the pixel circuits as described above. The timing diagram for programming and driving the display array of FIG. 6 is as shown in FIG. 2. Each programming and driving cycle may be the same as that of FIG. 4.

Figure 7A:
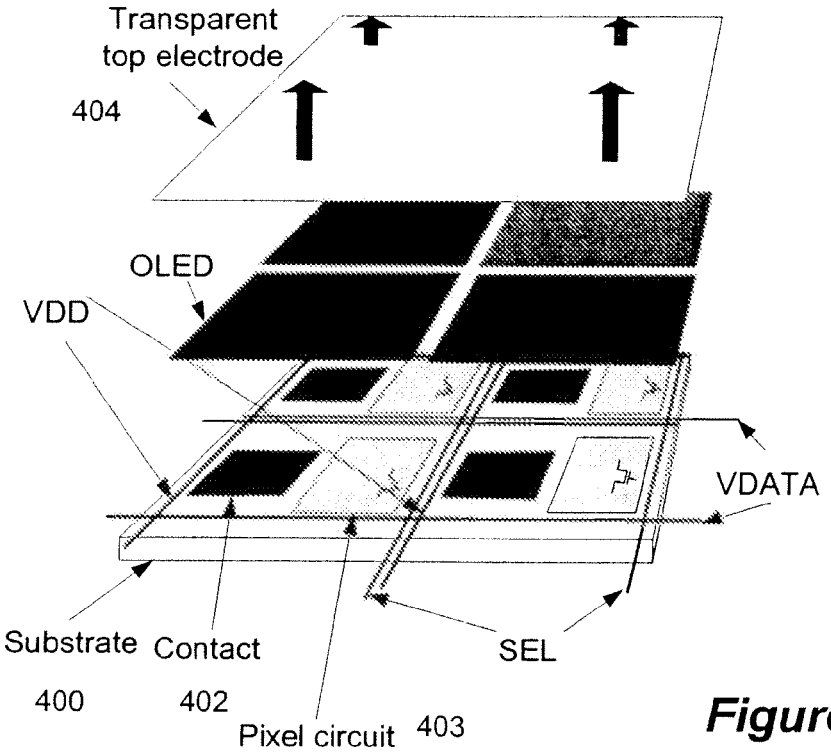
FIG. 7(*a*) is a diagram showing an example of the array structure having top emission pixels which are applicable to the array of FIG. 6.
Figure 7B:
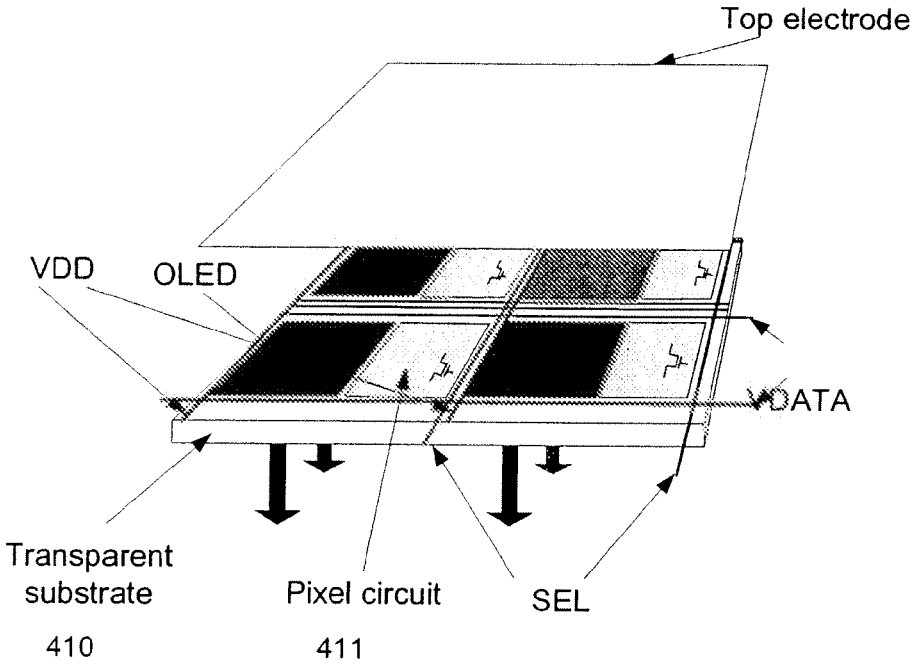

FIG. 7(*a*) illustrates an example of array structure having top emission pixels are arranged. FIG. 7(*b*) illustrates an example of array structure having bottom emission pixels are arranged. The array of FIG. 6 may have array structure shown in FIG. 7(*a*) or 7(*b*). In FIG. 7(*a*), 400 represents a substrate, 402 represents a pixel contact, 403 represents a (top emission) pixel circuit, and 404 represents a transparent top electrode on the OLEDs. In FIG. 7(*b*), 410 represents a transparent substrate, 411 represents a (bottom emission) pixel circuit, and 412 represents a top electrode. All of the pixel circuits including the TFTs, the storage capacitor, the SEL, VDATA, and VDD lines are fabricated together. After that, the OLEDs are fabricated for all pixel circuits. The OLED is connected to the corresponding driving transistor using a via (e.g. B1 of FIG. 3) as shown in FIGS. 7(*a*) and 7(*b*). The panel is finished by deposition of the top electrode on the OLEDs which can be a continuous layer, reducing the complexity of the design and can be used to turn the entire display ON/OFF or control the brightness.

Figure 8:
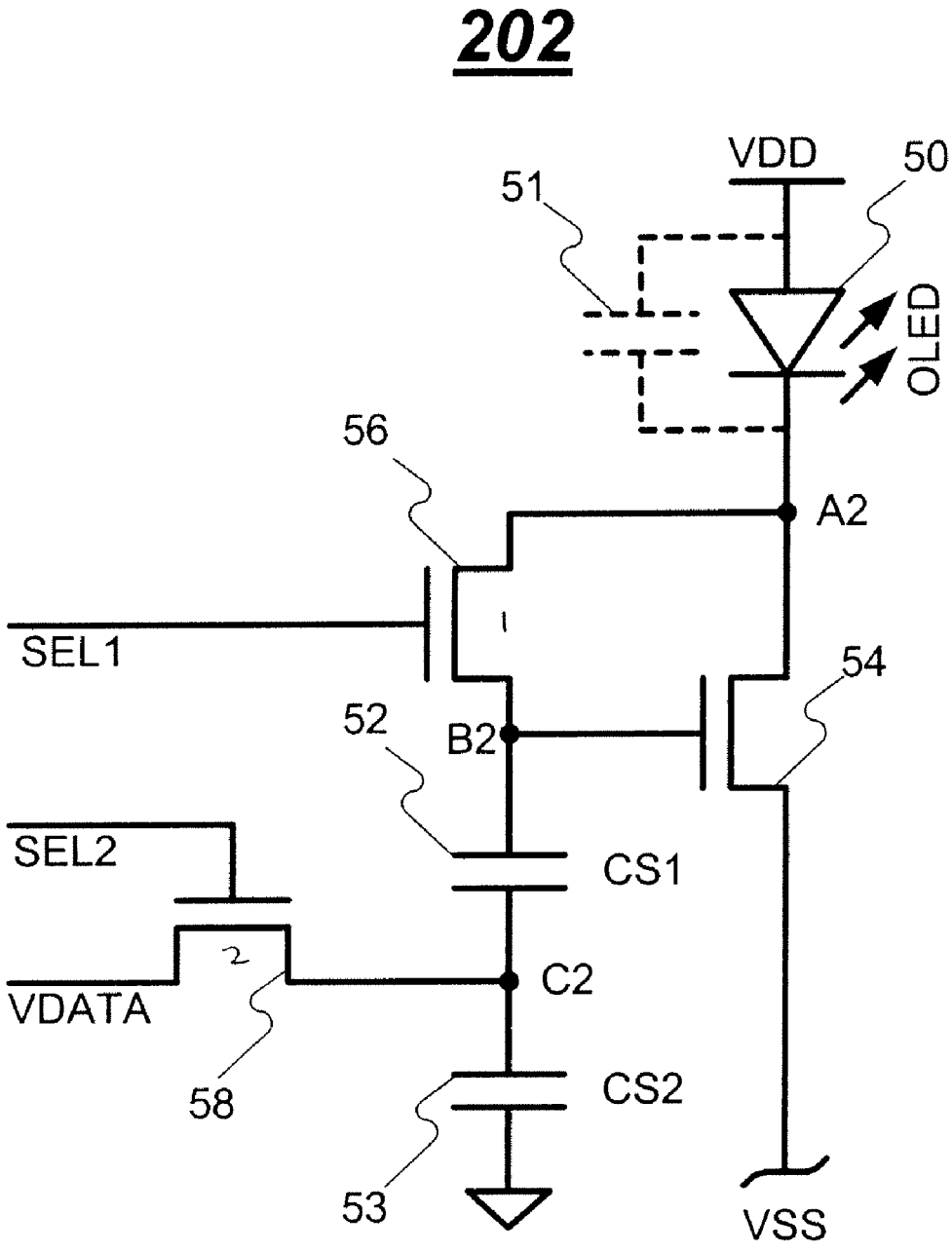
FIG. 8 is a diagram showing a pixel circuit to which programming and driving technique in accordance with a further embodiment of the present invention is applied.

FIG. 8 illustrates a pixel circuit 202 to which programming and driving technique in accordance with a further embodiment of the present invention is applied. The pixel circuit 202 includes an OLED 50, two storage capacitors 52 and 53, a driving transistor 54, and switch transistors 56 and 58. The pixel circuit 202 is a top emission, voltage programmed pixel circuit. This embodiment principally works in the same manner as that of FIG. 3. However, in the pixel circuit 202, the OLED 50 is connected to the drain terminal of the driving transistor 54. As a result, the circuit can be connected to the cathode of the OLED 50. Thus, the OLED deposition can be started with the cathode.

Figure 17:
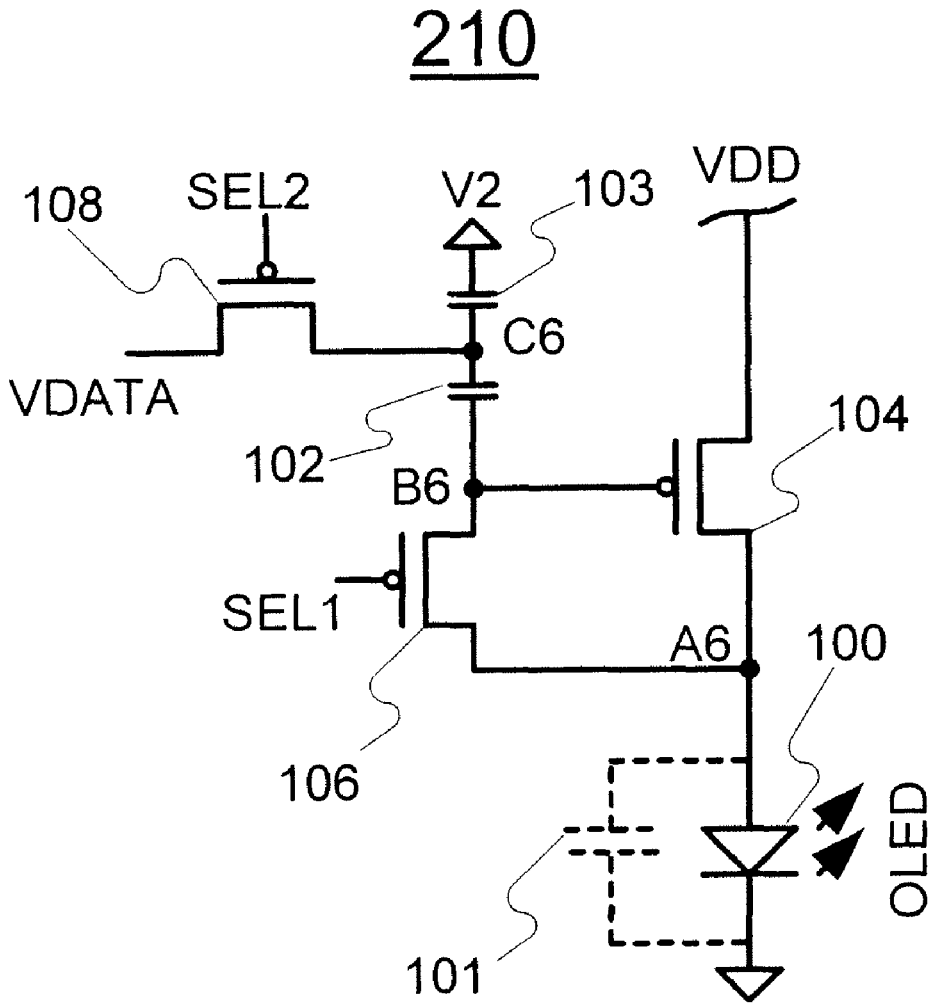
FIG. 17 is a diagram showing a pixel circuit to which programming and driving technique in accordance with a further embodiment of the present invention is applied.

The transistors 54, 56 and 58 are n-type TFTs. However, the transistors 54, 56 and 58 may be p-type transistors The driving technique applied to the pixel circuit 202 is also applicable to a complementary pixel circuit having p-type transistors as shown in FIG. 17. The transistors 54, 56 and 58 may be fabricated using amorphous silicon, nano/micro crystalline silicon, poly silicon, organic semiconductors technologies (e.g. organic TFT), NMOS/PMOS technology or CMOS technology (e.g. MOSFET).

The first terminal of the driving transistor 54 is connected to the cathode electrode of the OLED 50. The second terminal of the driving transistor 54 is connected to a controllable voltage supply line VSS. The gate terminal of the driving transistor 54 is connected to its first line (terminal) through the switch transistor 56. The storage capacitors 52 and 53 are in series, and are connected between the gate terminal of the driving transistor 54 and a common ground. The voltage on the voltage supply line VSS is controllable. The common ground may be connected to VSS.

The gate terminal of the switch transistor 56 is connected to a first select line SEL2. The first terminal of the switch transistor 56 is connected to the drain terminal of the driving transistor 54. The second terminal of the switch transistor 56 is connected to the gate terminal of the driving transistor 54.

The gate terminal of the switch transistor 58 is connected to a second select line SEL2. The first terminal of the switch transistor 58 is connected to a signal line VDATA. The second terminal of the switch transistor 58 is connected to the shared terminal of the storage capacitors 52 and 53 (i.e. node C2). The anode electrode of the OLED 50 is connected to a voltage supply electrode VDD.

The OLED 50 and the transistors 54 and 56 are connected at node A2. The storage capacitor 52 and the transistors 54 and 56 are connected at node B2.

Figure 9:
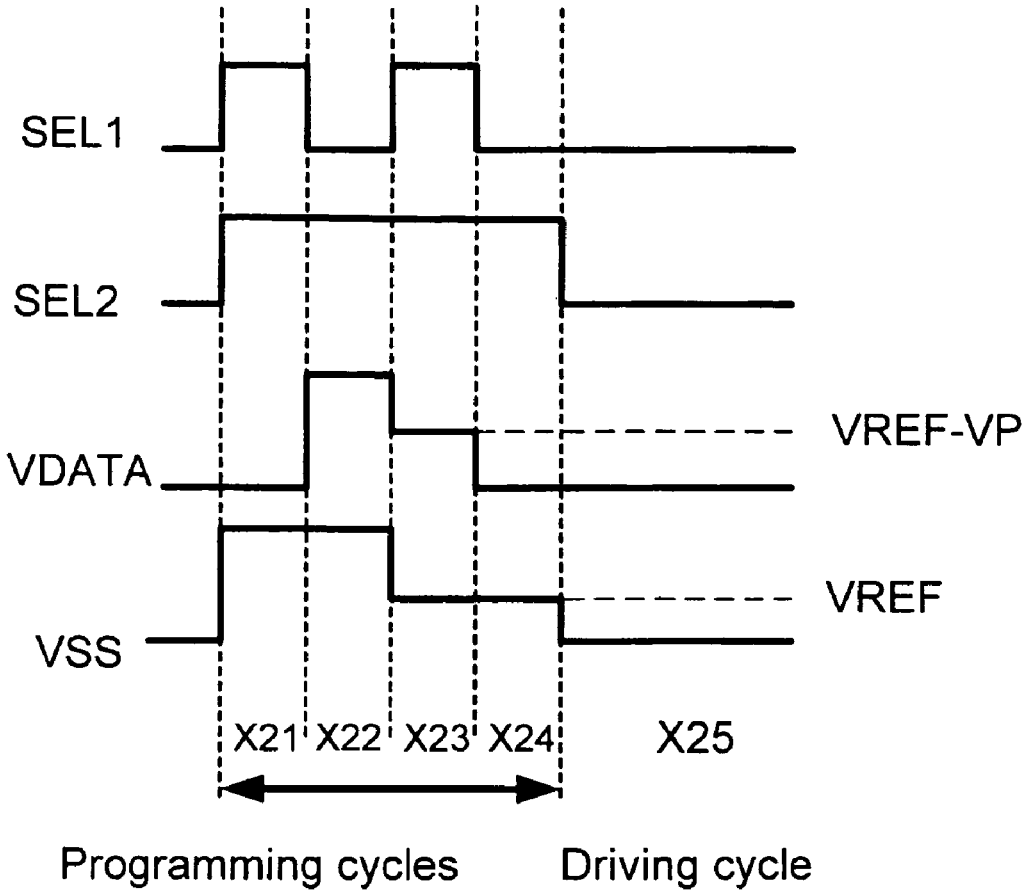
FIG. 9 is a timing diagram showing an example of waveforms for programming and driving the pixel circuit of FIG. 8.

FIG. 9 illustrates a timing diagram showing an example of waveforms for programming and driving the pixel circuit 202 of FIG. 8. Referring to FIGS. 8 and 9, the operation of the pixel circuit 202 includes a programming cycle having four operating cycles X21, X22, X23 and X24, and a driving cycle having one operating cycle X25.

During the programming cycle, a programming voltage plus the threshold voltage of the driving transistor 54 is stored in the storage capacitor 52. The source terminal of the driving transistor 54 goes to zero, and the second storage capacitor 53 is charged to zero.

As a result, the gate-source voltage of the driving transistor 54 goes to:

$$VGS=VP+VT \quad (2)$$

where VGS represents the gate-source voltage of the driving transistor 54, VP represents the programming voltage, and VT represents the threshold voltage of the driving transistor 54.

In the first operating cycle X21: VSS goes to a high positive voltage, and VDATA is zero. SEL1 and SEL2 are high. Therefore, nodes A2 and B2 are charged to a positive voltage.

In the second operating cycle X22: While SEL1 is low and the switch transistor 56 is off, VDATA goes to a high positive voltage. As a result, the voltage at node B2 increases (i.e. bootstrapping) and node A2 is charged to the voltage of VSS. At this voltage, the OLED 50 is off.

In the third operating cycle X23: VSS goes to a reference voltage VREF. VDATA goes to (VREF−VP). At the beginning of this cycle, the voltage of node B2 becomes almost equal to the voltage of node A2 because the capacitance 51 of the OLED 50 is bigger than that of the storage capacitor 52. After that, the voltage of node B2 and the voltage of node A2 are discharged through the driving transistor 54 until the driving transistor 54 turns off. As a result, the gate-source voltage of the driving transistor 54 is (VREF+VT), and the voltage stored in storage capacitor 52 is (VP+VT).

In the fourth operating cycle X24: SEL1 is low. Since SEL2 is high, and VDATA is zero, the voltage at node C2 goes to zero.

In the fifth operating cycle X25: VSS goes to its operating voltage during the driving cycle. In FIG. 5, the operating voltage of VSS is zero. However, it may be any voltage other than zero. SEL2 is low. The voltage stored in the storage capacitor 52 is applied to the gate terminal of the driving transistor 54. Accordingly, a current independent of the threshold voltage VT of the driving transistor 54 and the voltage of the OLED 50 flows through the driving transistor 54 and the OLED 50. Thus, the degradation of the OLED 50 and instability of the driving transistor 54 does not affect the amount of the current flowing through the driving transistor 54 and the OLED 50.

Figure 10:
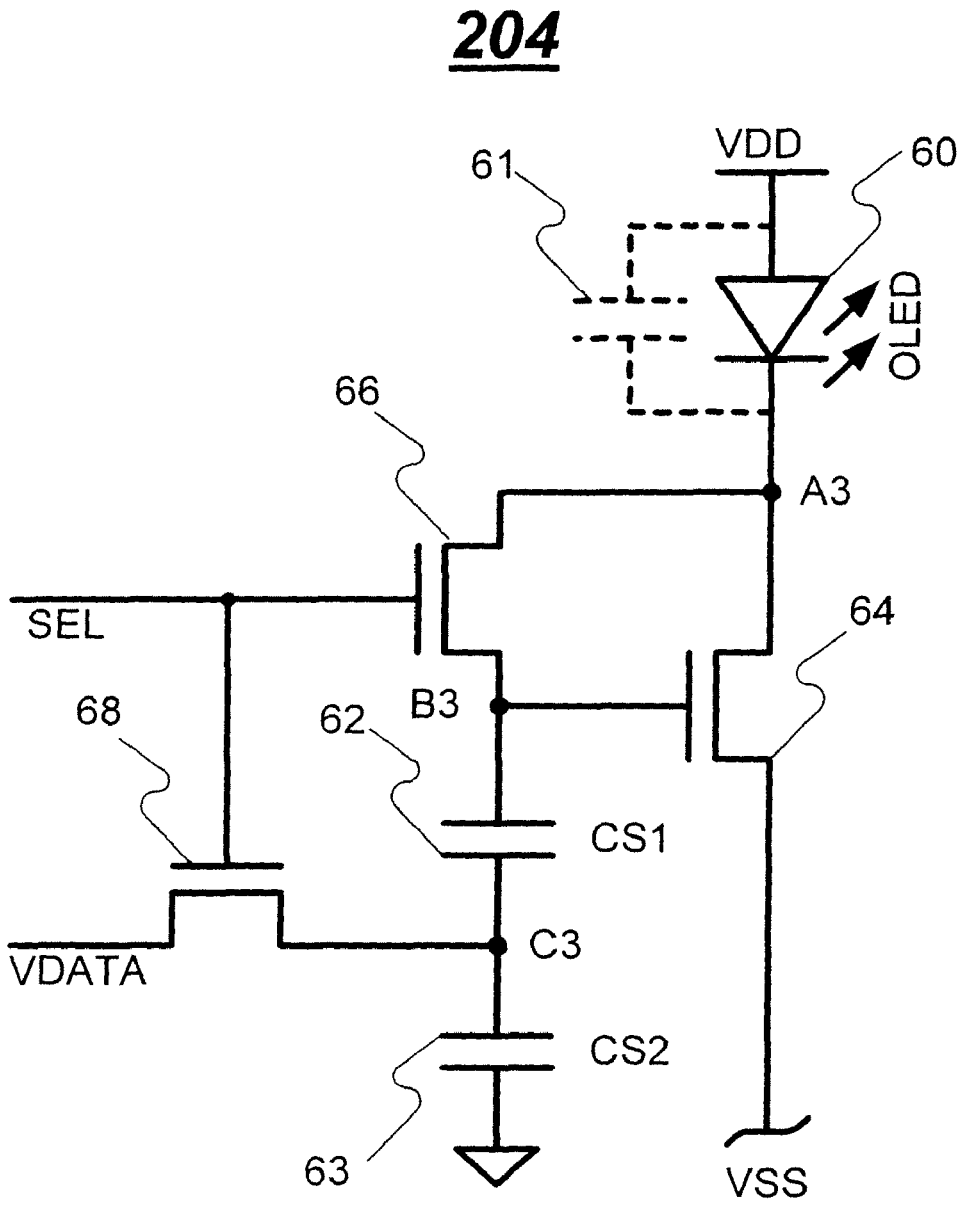
FIG. 10 is a diagram showing a pixel circuit to which programming and driving technique in accordance with a further embodiment of the present invention is applied.

FIG. 10 illustrates a pixel circuit 204 to which programming and driving technique in accordance with a further embodiment of the present invention is applied. The pixel circuit 204 includes an OLED 60, two storage capacitors 62 and 63, a driving transistor 64, and switch transistors 66 and 68. The pixel circuit 204 is a top emission, voltage programmed pixel circuit. The pixel circuit 204 principally works similar to that of in FIG. 8. However, one common select line is used to operate the pixel circuit 204, which can increase the available pixel area and aperture ratio.

Figure 19:
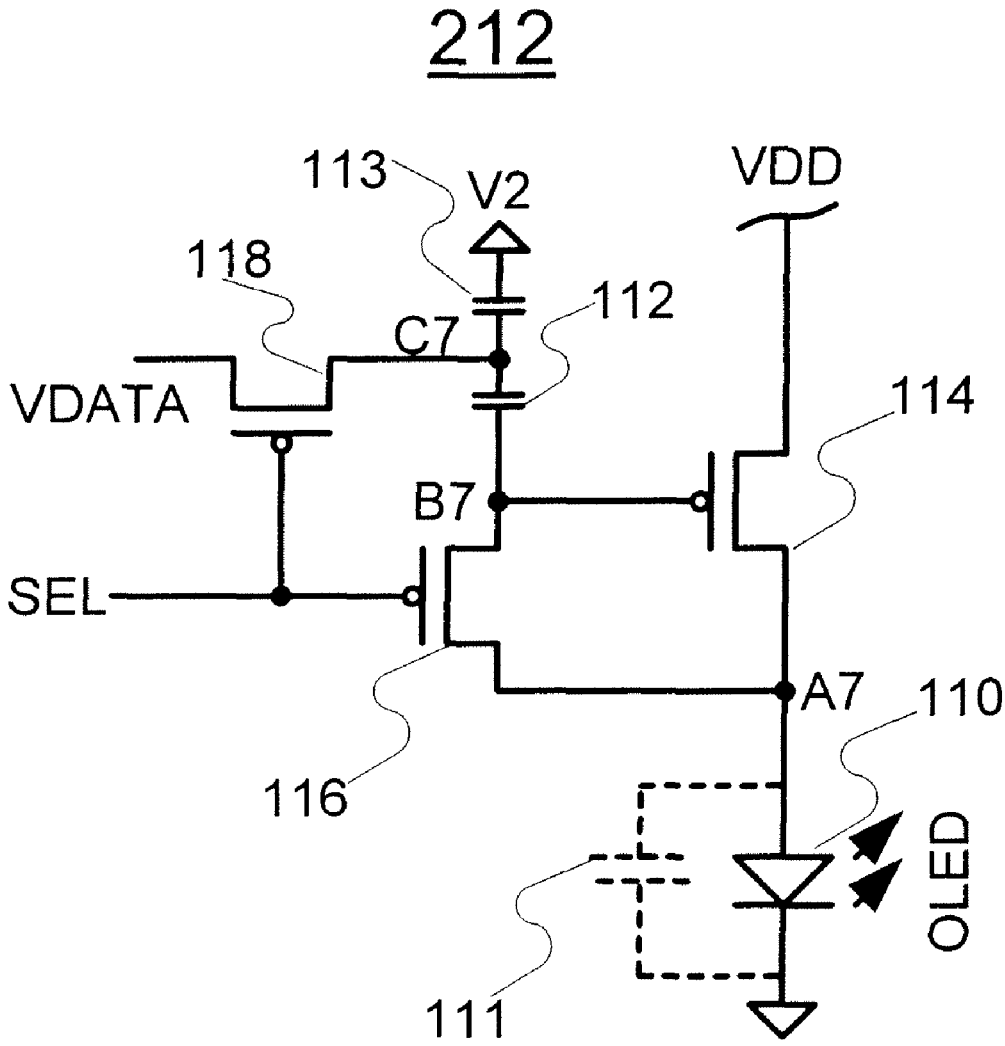
FIG. 19 is a diagram showing a pixel circuit to which programming and driving technique in accordance with a further embodiment of the present invention is applied.

The transistors 64, 66 and 68 are n-type TFTs. However, The transistors 64, 66 and 68 may be p-type transistors. The driving technique applied to the pixel circuit 204 is also applicable to a complementary pixel circuit having p-type transistors as shown in FIG. 19. The transistors 64, 66 and 68 may be fabricated using amorphous silicon, nano/micro crystalline silicon, poly silicon, organic semiconductors technologies (e.g. organic TFT), NMOS/PMOS technology or CMOS technology (e.g. MOSFET).

The first terminal of the driving transistor 64 is connected to the cathode electrode of the OLED 60. The second terminal of the driving transistor 64 is connected to a controllable voltage supply line VSS. The gate terminal of the driving transistor 64 is connected to its first line (terminal) through the switch transistor 66. The storage capacitors 62 and 63 are in series, and are connected between the gate terminal of the driving transistor 64 and the common ground. The voltage of the voltage supply line VSS is controllable. The common ground may be connected to VSS.

The gate terminal of the switch transistor 66 is connected to a select line SEL. The first terminal of the switch transistor 66 is connected to the first terminal of the driving transistor 64. The second terminal of the switch transistor 66 is connected to the gate terminal of the driving transistor 64.

The gate terminal of the switch transistor 68 is connected to the select line SEL. The first terminal of the switch transistor 68 is connected to a signal line VDATA. The second terminal is connected to the shared terminal of storage capacitors 62 and 63 (i.e. node C3). The anode electrode of the OLED 60 is connected to a voltage supply electrode VDD.

The OLED 60 and the transistors 64 and 66 are connected at node A3. The storage capacitor 62 and the transistors 64 and 66 are connected at node B3.

Figure 11:
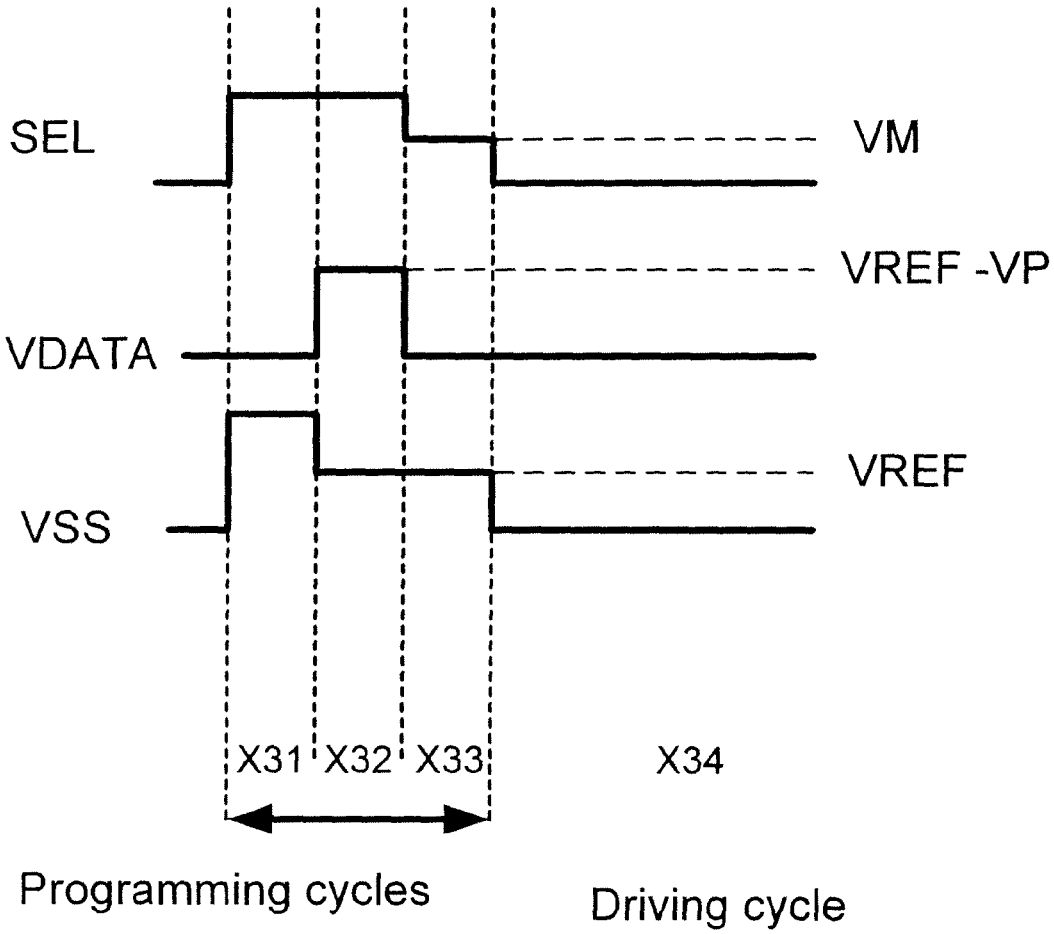
FIG. 11 is a timing diagram showing an example of waveforms for programming and driving the pixel circuit of FIG. 10.

FIG. 11 illustrates a timing diagram showing an example of waveforms for programming and driving the pixel circuit 204 of FIG. 10. Referring to FIGS. 10 and 11, the operation of the pixel circuit 204 includes a programming cycle having three operating cycles X31, X32 and X33, and a driving cycle includes one operating cycle X34.

During the programming cycle, a programming voltage plus the threshold voltage of the driving transistor 64 is stored in the storage capacitor 62. The source terminal of the driving transistor 64 goes to zero and the storage capacitor 63 is charged to zero.

As a result, the gate-source voltage of the driving transistor 64 goes to:

$$VGS=VP+VT \quad (3)$$

where VGS represents the gate-source voltage of the driving transistor 64, VP represents the programming voltage, and VT represents the threshold voltage of the driving transistor 64.

In the first operating cycle X31: VSS goes to a high positive voltage, and VDATA is zero. SEL is high. As a result, nodes A3 and B3 are charged to a positive voltage. The OLED 60 turns off.

In the second operating cycle X32: While SEL is high, VSS goes to a reference voltage VREF. VDATA goes to (VREF-VP). As a result, the voltage at node B3 and the voltage of node A3 are discharged through the driving transistor 64 until the driving transistor 64 turns off. The voltage of node B3 is (VREF+VT), and the voltage stored in the storage capacitor 62 is (VP+VT).

In the third operating cycle X33: SEL goes to VM. VM is an intermediate voltage in which the switch transistor 66 is off and the switch transistor 68 is on. VDATA goes to zero. Since SEL is VM and VDATA is zero, the voltage of node C3 goes to zero.

VM is defined as:

$$VT3<<VM<VREF+VT1+VT2 \quad (a)$$

where VT1 represents the threshold voltage of the driving transistor 64, VT2 represents the threshold voltage of the switch transistor 66, and VT3 represents the threshold voltage of the switch transistor 68.

The condition (a) forces the switch transistor 66 to be off and the switch transistor 68 to be on. The voltage stored in the storage capacitor 62 remains intact.

In the fourth operating cycle X34: VSS goes to its operating voltage during the driving cycle. In FIG. 11, the operating voltage of VSS is zero. However, the operating voltage of VSS may be any voltage other than zero. SEL is low. The voltage stored in the storage capacitor 62 is applied to the gate of the driving transistor 64. The driving transistor 64 is ON. Accordingly, a current independent of the threshold voltage VT of the driving transistor 64 and the voltage of the OLED 60 flows through the driving transistor 64 and the OLED 60. Thus, the degradation of the OLED 60 and instability of the driving transistor 64 does not affect the amount of the current flowing through the driving transistor 64 and the OLED 60.

Figure 12:
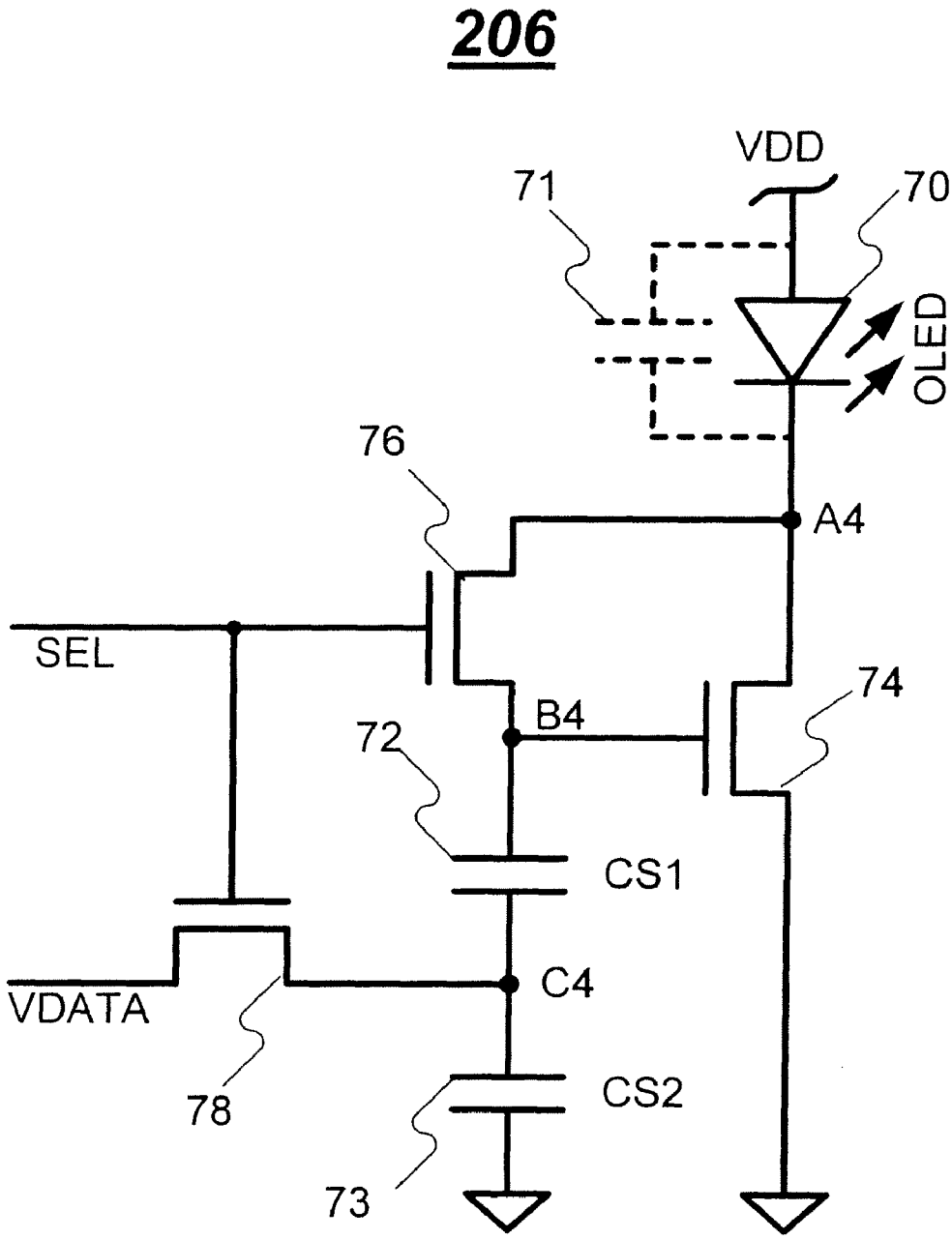
FIG. 12 is a diagram showing a pixel circuit to which programming and driving technique in accordance with a further embodiment of the present invention is applied.

FIG. 12 illustrates a pixel circuit 206 to which programming and driving technique in accordance with a further embodiment of the present invention is applied. The pixel circuit 206 includes an OLED 70, two storage capacitors 72 and 73, a driving transistor 74, and switch transistors 76 and 78. The pixel circuit 206 is a top emission, voltage programmed pixel circuit.

Figure 21:
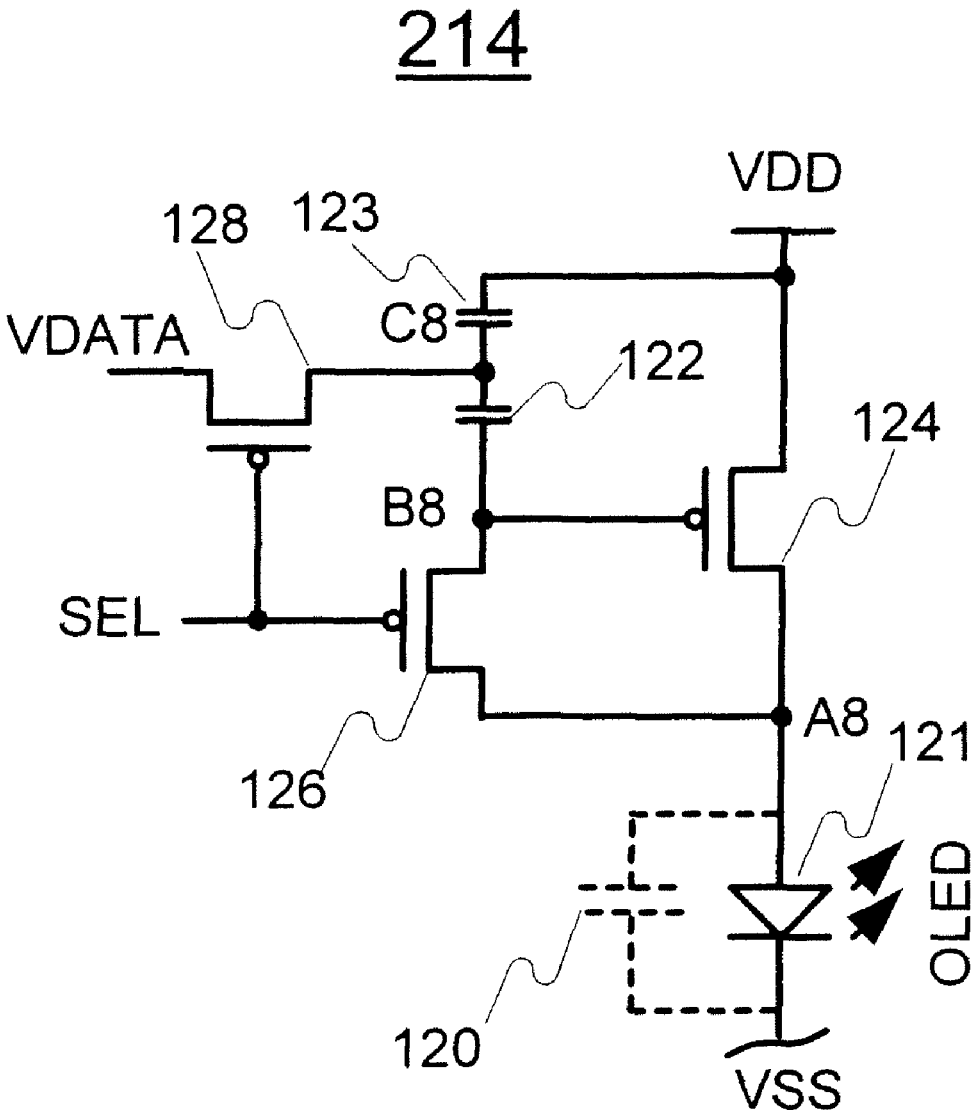
FIG. 21 is a diagram showing a pixel circuit to which programming and driving technique in accordance with a further embodiment of the present invention is applied.

The transistors 74, 76 and 78 are n-type TFTs. However, the transistors 74, 76 and 78 may be p-type transistors. The driving technique applied to the pixel circuit 206 is also applicable to a complementary pixel circuit having p-type transistors as shown in FIG. 21. The transistors 74, 76 and 78 may be fabricated using amorphous silicon, nano/micro crystalline silicon, poly silicon, organic semiconductors technologies (e.g. organic TFT), NMOS/PMOS technology or CMOS technology (e.g. MOSFET).

The first terminal of the driving transistor 74 is connected to the cathode electrode of the OLED 70. The second terminal of the driving transistor 74 is connected to a common ground. The gate terminal of the driving transistor 74 is connected to its first line (terminal) through the switch transistor 76. The storage capacitors 72 and 73 are in series, and are connected between the gate terminal of the driving transistor 74 and the common ground.

The gate terminal of the switch transistor 76 is connected to a select line SEL. The first terminal of the switch transistor 76 is connected to the first terminal of the driving transistor 74. The second terminal of the switch transistor 76 is connected to the gate terminal of the driving transistor 74.

The gate terminal of the switch transistor 78 is connected to the select line SEL. The first terminal of the switch transistor 78 is connected to a signal line VDATA. The second terminal is connected to the shared terminal of storage capacitors 72 and 73 (i.e. node C4). The anode electrode of the OLED 70 is connected to a voltage supply electrode VDD. The voltage of the voltage electrode VDD is controllable.

The OLED 70 and the transistors 74 and 76 are connected at node A4. The storage capacitor 72 and the transistors 74 and 76 are connected at node B4.

Figure 13:
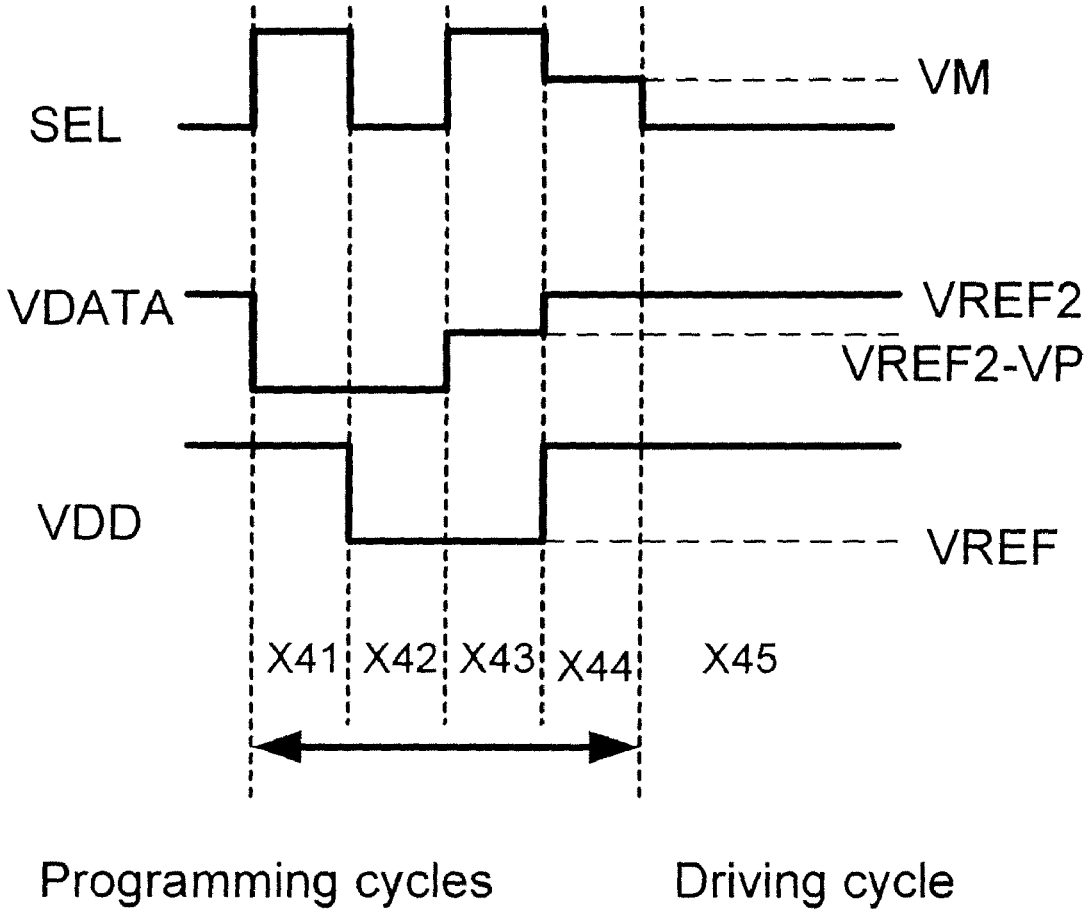
FIG. 13 is a timing diagram showing an example of waveforms for programming and driving the pixel circuit of FIG. 12.

FIG. 13 illustrates a timing diagram showing an example of waveforms for programming and driving the pixel circuit 206 of FIG. 12. Referring to FIGS. 12 and 13, the operation of the pixel circuit 206 includes a programming cycle having four operating cycles X41, X42, X43 and X44, and a driving cycle having one driving cycle 45.

During the programming cycle, a programming voltage plus the threshold voltage of the driving transistor 74 is stored in the storage capacitor 72. The source terminal of the driving transistor 74 goes to zero and the storage capacitor 73 is charged to zero.

As a result, the gate-source voltage of the driving transistor 74 goes to:

$$VGS=VP+VT \tag{4}$$

where VGS represents the gate-source voltage of the driving transistor 74, VP represents the programming voltage, and VT represents the threshold voltage of the driving transistor 74.

In the first operating cycle X41: SEL is high. VDATA goes to a low voltage. While VDD is high, node B4 and node A4 are charged to a positive voltage.

In the second operating cycle X42: SEL is low, and VDD goes to a reference voltage VREF where the OLED 70 is off.

In the third operating cycle X43: VDATA goes to (VREF2−VP) where VREF2 is a reference voltage. It is assumed that VREF2 is zero. However, VREF2 can be any voltage other than zero. SEL is high. Therefore, the voltage of node B4 and the voltage of node A4 become equal at the beginning of this cycle. It is noted that the first storage capacitor 72 is large enough so that its voltage becomes dominant. After that, node B4 is discharged through the driving transistor 74 until the driving transistor 74 turns off.

As a result, the voltage of node B4 is VT (i.e. the threshold voltage of the driving transistor 74). The voltage stored in the first storage capacitor 72 is (VP−VREF2+VT)=(VP+VT) where VREF2=0.

In the fourth operating cycle X44: SEL goes to VM where VM is an intermediate voltage at which the switch transistor 76 is off and the switch transistor 78 is on. VM satisfies the following condition:

$$VT3 \ll VM < VP+VT \tag{b}$$

where VT3 represents the threshold voltage of the switch transistor 78.

VDATA goes to VREF2 (=0). The voltage of node C4 goes to VREF2 (=0).

This results in that the gate-source voltage VGS of the driving transistor 74 is (VP+VT). Since VM<VP+VT, the switch transistor 76 is off, and the voltage stored in the storage capacitor 72 stays at VP+VT.

In the fifth operating cycle X45: VDD goes to the operating voltage. SEL is low. The voltage stored in the storage capacitor 72 is applied to the gate of the driving transistor 74. Accordingly, a current independent of the threshold voltage VT of the driving transistor 74 and the voltage of the OLED 70 flows through the driving transistor 74 and the OLED 70. Thus, the degradation of the OLED 70 and instability of the driving transistor 74 does not affect the amount of the current flowing through the driving transistor 74 and the OLED 70.

FIG. 14 illustrates a pixel circuit 208 to which programming and driving technique in accordance with a further embodiment of the present invention is applied. The pixel circuit 208 includes an OLED 80, a storage capacitor 81, a driving transistor 84 and a switch transistor 86. The pixel circuit 208 corresponds to the pixel circuit 200 of FIG. 3, and a voltage programmed pixel circuit.

The transistors 84 and 86 are p-type TFTs. The transistors 84 and 86 may be fabricated using amorphous silicon, nano/micro crystalline silicon, poly silicon, organic semiconductors technologies (e.g. organic TFT), CMOS technology (e.g. MOSFET) and any other technology which provides p-type transistors.

The first terminal of the driving transistor 84 is connected to a controllable voltage supply line VSS. The second terminal of the driving transistor 84 is connected to the cathode electrode of the OLED 80. The gate terminal of the driving transistor 84 is connected to a signal line VDATA through the switch transistor 86. The storage capacitor 81 is connected between the second terminal and the gate terminal of the driving transistor 84.

The gate terminal of the switch transistor 86 is connected to a select line SEL. The first terminal of the switch transistor 86 is connected to the signal line VDATA. The second terminal of the switch transistor 86 is connected to the gate terminal of the driving transistor 84. The anode electrode of the OLED 80 is connected to a ground voltage supply electrode.

The storage capacitor 81 and the transistors 84 and 85 are connected at node A5. The OLED 80, the storage capacitor 81 and the driving transistor 84 are connected at node B5.

Figure 15:
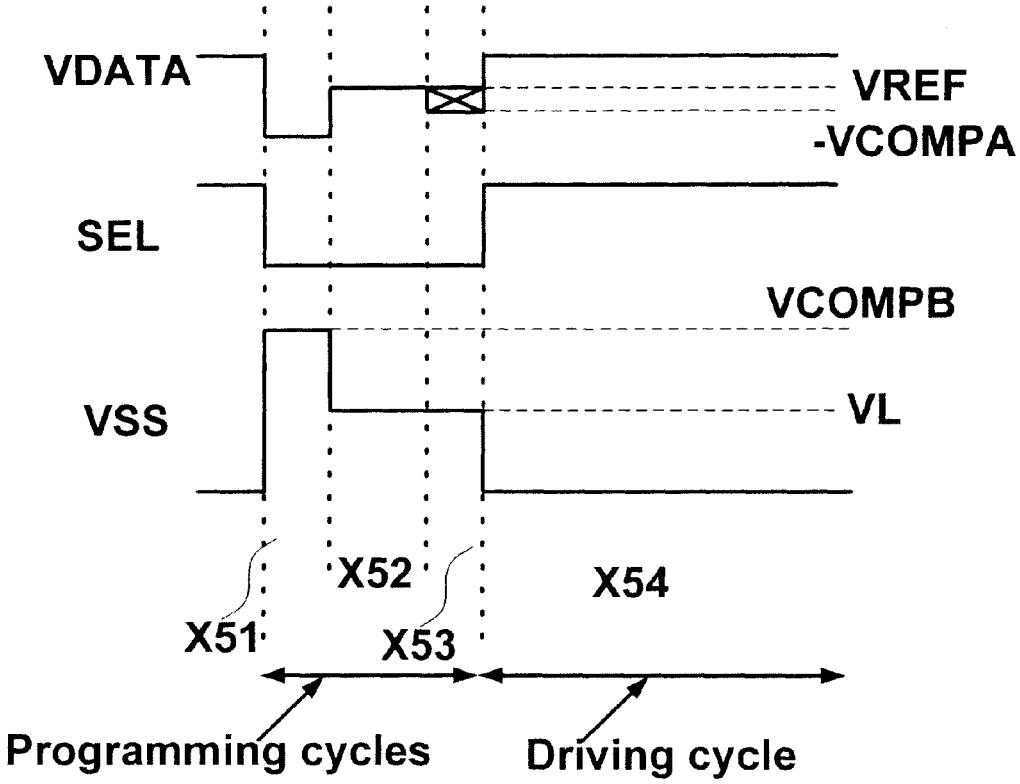
FIG. 15 is a timing diagram showing an example of waveforms for programming and driving the pixel circuit of FIG. 14.

FIG. 15 illustrates a timing diagram showing an example of waveforms for programming and driving the pixel circuit 208 of Figure. FIG. 15 corresponds to FIG. 4. VDATA and VSS are used to programming and compensating for a time dependent parameter of the pixel circuit 208, which are similar to VDATA and VDD of FIG. 4. Referring to FIGS. 14 and 15, the operation of the pixel circuit 208 includes a programming cycle having three operating cycles X51, X52 and X53, and a driving cycle having one operating cycle X54.

During the programming cycle, node B5 is charged to a positive threshold voltage of the driving transistor 84, and node A5 is charged to a negative programming voltage.

As a result, the gate-source voltage of the driving transistor 84 goes to:

$$VGS=-VP+(-|VT|)=-VP-|VT| \quad (5)$$

where VGS represents the gate-source voltage of the driving transistor 84, VP represents the programming voltage, and VT represents the threshold voltage of the driving transistor 84.

In the first operating cycle X51: VSS goes to a positive compensating voltage VCOMPB, and VDATA goes to a negative compensating voltage (−VCOMPA), and SEL is low. As a result, the switch transistor 86 is on. Node A5 is charged to (−VCOMPA). Node B5 is charged to VCOMPB.

In the second operating cycle X52: VDATA goes to a reference voltage VREF. Node B5 is discharged through the driving transistor 84 until the driving transistor 84 turns off. As a result, the voltage of node B5 reaches VREF+|VT|. VSS goes to a negative voltage VL to increase the speed of this cycle X52. For the optimal setting time, VL is selected to be equal to the operating voltage which is the voltage of VSS during the driving cycle.

In the third operating cycle X53: While VSS is in the VL level, and SEL is low, node A5 is charged to (VREF−VP). Because the capacitance 82 of the OLED 80 is large, the voltage of node B5 stays at the positive threshold voltage of the driving transistor 84. Therefore, the gate-source voltage of the driving transistor 84 is (<VP−|NT|), which is stored in storage capacitor 81.

In the fourth operating cycle X54: SEL and VDATA go to zero. VSS goes to a high negative voltage (i.e. its operating voltage). The voltage stored in the storage capacitor 81 is applied to the gate terminal of the driving transistor 84. Accordingly, a current independent of the voltage of the OLED 80 and the threshold voltage of the driving transistor 84 flows through the driving transistor 84 and the OLED 80. Thus, the degradation of the OLED 80 and instability of the driving transistor 84 does not affect the amount of the current flowing through the driving transistor 84 and the OLED 80.

It is noted that the pixel circuit 208 can be operated with different values of VCOMPB, VCOMPA, VL, VREF and VP. VCOMPB, VCOMPA, VL, VREF and VP define the lifetime of the pixel circuit. Thus, these voltages can be defined in accordance with the pixel specifications.

Figure 16:
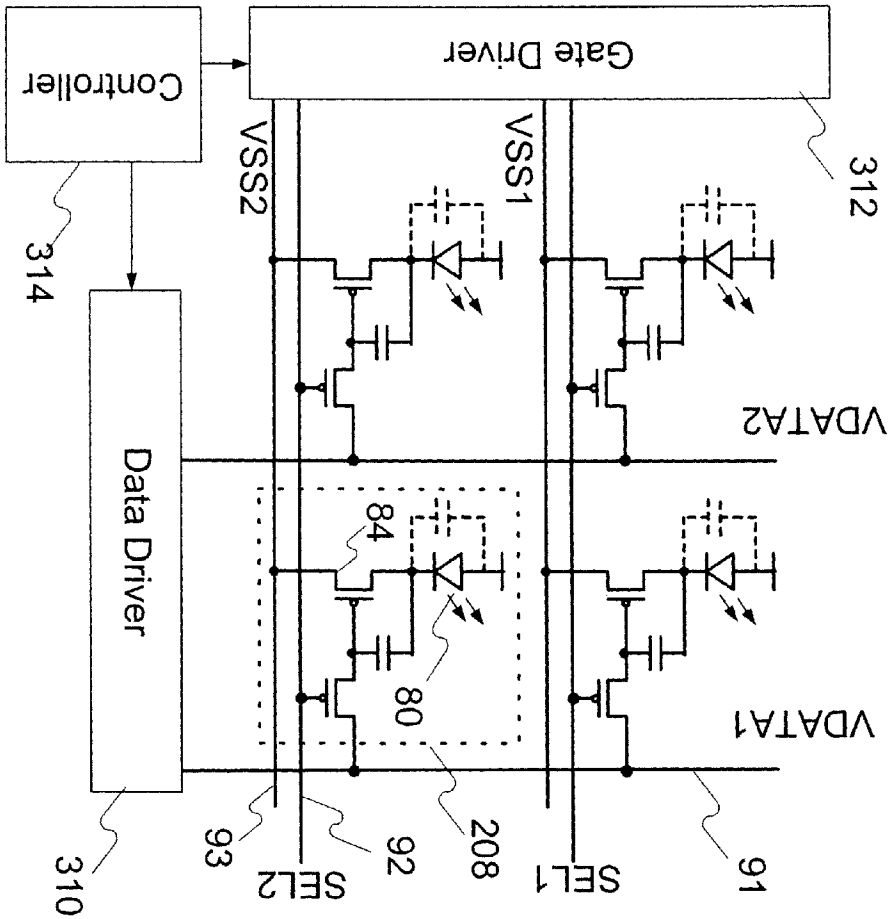
FIG. 16 is a diagram showing a display system having the pixel circuit of FIG. 14.

FIG. 16 illustrates a display system having the pixel circuit 208 of FIG. 14. VSS1 and VSS2 of FIG. 16 correspond to VSS of FIG. 14. SEL1 and SEL2 of FIG. 16 correspond to SEL of FIG. 14. VDATA1 and VDATA2 of FIG. 16 correspond to VDATA of FIG. 14. The array of FIG. 16 is an active matrix light emitting diode (AMOLED) display having a plurality of the pixel circuits 208 of FIG. 14. The pixel circuits 208 are arranged in rows and columns, and interconnections 91, 92 and 93 (VDATA1, SEL2, VSS2). VDATA1 (or VDATA 2) is shared between the common column pixels while SEL1 (or SEL2) and VSS1 (or VSS2) are shared between common row pixels in the array structure.

A driver 310 is provided for driving VDATA1 and VDATA2. A driver 312 is provided for driving VSS1, VSS2, SEL1 and SEL2. A controller 314 controls the drivers 310 and 312 to implement the programming and driving cycles described above. The timing diagram for programming and driving the display array of FIG. 6 is as shown in FIG. 2. Each programming and driving cycle may be the same as that of FIG. 15.

The array of FIG. 16 may have array structure shown in FIG. 7(*a*) or 7(*b*). The array of FIG. 16 is produced in a manner similar to that of FIG. 6. All of the pixel circuits including the TFTs, the storage capacitor, the SEL, VDATA, and VSS lines are fabricated together. After that, the OLEDs are fabricated for all pixel circuits. The OLED is connected to the corresponding driving transistor using a via (e.g. B5 of FIG. 14). The panel is finished by deposition of the top electrode on the OLEDs which can be a continuous layer, reducing the complexity of the design and can be used to turn the entire display ON/OFF or control the brightness.

FIG. 17 illustrates a pixel circuit 210 to which programming and driving technique in accordance with a further embodiment of the present invention is applied. The pixel circuit 210 includes an OLED 100, two storage capacitors 102 and 103, a driving transistor 104, and switch transistors 106 and 108. The pixel circuit 210 corresponds to the pixel circuit 202 of FIG. 8.

The transistors 104, 106 and 108 are p-type TFTs. The transistors 84 and 86 may be fabricated using amorphous silicon, nano/micro crystalline silicon, poly silicon, organic semiconductors technologies (e.g. organic TFT), CMOS technology (e.g. MOSFET) and any other technology which provides p-type transistors.

In FIG. 17, one of the terminals of the driving transistor 104 is connected to the anode electrode of the OLED 100, while the other terminal is connected to a controllable voltage supply line VDD. The storage capacitors 102 and 103 are in series, and are connected between the gate terminal of the driving transistor 104 and a voltage supply electrode V2. Also, V2 may be connected to VDD. The cathode electrode of the OLED 100 is connected to a ground voltage supply electrode.

The OLED 100 and the transistors 104 and 106 are connected at node A6. The storage capacitor 102 and the transistors 104 and 106 are connected at node B6. The transistor 108 and the storage capacitors 102 and 103 are connected at node C6.

Figure 18:
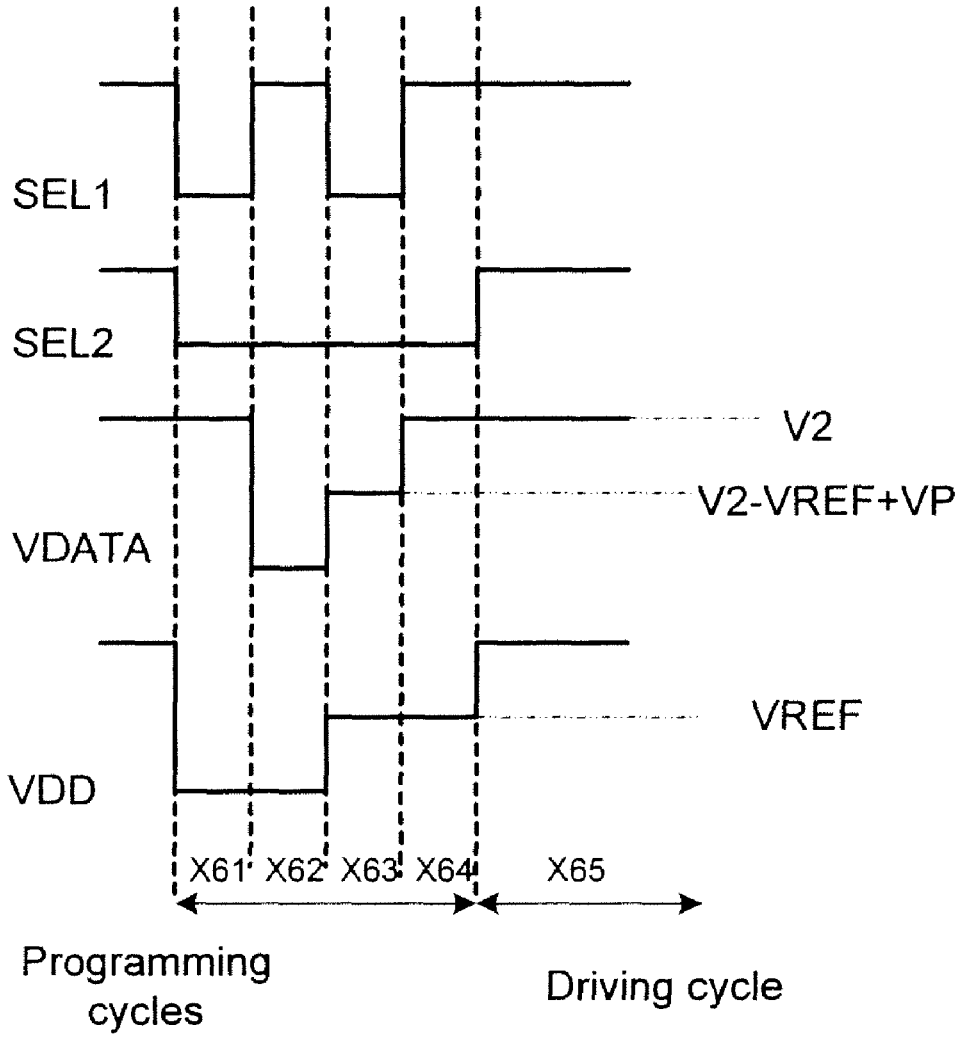
FIG. 18 is a timing diagram showing an example of waveforms for programming and driving the pixel circuit of FIG. 17.

FIG. 18 illustrates a timing diagram showing an example of waveforms for programming and driving the pixel circuit 210 of FIG. 17. FIG. 18 corresponds to FIG. 9. VDATA and VDD are used to programming and compensating for a time dependent parameter of the pixel circuit 210, which are similar to VDATA and VSS of FIG. 9. Referring to FIGS. 17 and 18, the operation of the pixel circuit 210 includes a programming cycle having four operating cycles X61, X62, X63 and X64, and a driving cycle having one operating cycle X65.

During the programming cycle, a negative programming voltage plus the negative threshold voltage of the driving transistor 104 is stored in the storage capacitor 102, and the second storage capacitor 103 is discharged to zero.

As a result, the gate-source voltage of the driving transistor 104 goes to:

$$VGS=-VP-|VT| \quad (6)$$

where VGS represents the gate-source voltage of the driving transistor 104, VP represents the programming voltage, and VT represents the threshold voltage of the driving transistor 104.

In the first operating cycle X61: VDD goes to a high negative voltage, and VDATA is set to V2. SEL1 and SEL2 are low. Therefore, nodes A6 and B6 are charged to a negative voltage.

In the second operating cycle X62: While SEL1 is high and the switch transistor 106 is off, VDATA goes to a negative voltage. As a result, the voltage at node B6 decreases, and the voltage of node A6 is charged to the voltage of VDD. At this voltage, the OLED 100 is off.

In the third operating cycle X63: VDD goes to a reference voltage VREF. VDATA goes to (V2−VREF+VP) where VREF is a reference voltage. It is assumed that VREF is zero. However, VREF may be any voltage other than zero. At the beginning of this cycle, the voltage of node B6 becomes almost equal to the voltage of node A6 because the capacitance 101 of the OLED 100 is bigger than that of the storage capacitor 102. After that, the voltage of node B6 and the voltage of node A6 are charged through the driving transistor 104 until the driving transistor 104 turns off. As a result, the gate-source voltage of the driving transistor 104 is (−VP−|VT|), which is stored in the storage capacitor 102.

In the fourth operating cycle X64: SEL1 is high. Since SEL2 is low, and VDATA goes to V2, the voltage at node C6 goes to V2.

In the fifth operating cycle X65: VDD goes to its operating voltage during the driving cycle. In FIG. 18, the operating voltage of VDD is zero. However, the operating voltage of VDD may be any voltage. SEL2 is high. The voltage stored in the storage capacitor 102 is applied to the gate terminal of the driving transistor 104. Thus, a current independent of the threshold voltage VT of the driving transistor 104 and the voltage of the OLED 100 flows through the driving transistor 104 and the OLED 100. Accordingly, the degradation of the OLED 100 and instability of the driving transistor 104 do not affect the amount of the current flowing through the driving transistor 54 and the OLED 100.

FIG. 19 illustrates a pixel circuit 212 to which programming and driving technique in accordance with a further embodiment of the present invention is applied. The pixel circuit 212 includes an OLED 110, two storage capacitors 112 and 113, a driving transistor 114, and switch transistors 116 and 118. The pixel circuit 212 corresponds to the pixel circuit 204 of FIG. 10.

The transistors 114, 116 and 118 are p-type TFTs. The transistors 84 and 86 may be fabricated using amorphous silicon, nano/micro crystalline silicon, poly silicon, organic semiconductors technologies (e.g. organic TFT), CMOS technology (e.g. MOSFET) and any other technology which provides p-type transistors.

In FIG. 19, one of the terminals of the driving transistor 114 is connected to the anode electrode of the OLED 110, while the other terminal is connected to a controllable voltage supply line VDD. The storage capacitors 112 and 113 are in series, and are connected between the gate terminal of the driving transistor 114 and a voltage supply electrode V2. Also, V2 may be connected to VDD. The cathode electrode of the OLED 100 is connected to a ground voltage supply electrode.

The OLED 110 and the transistors 114 and 116 are connected at node A7. The storage capacitor 112 and the transistors 114 and 116 are connected at node B7. The transistor 118 and the storage capacitors 112 and 113 are connected at node C7.

Figure 20:
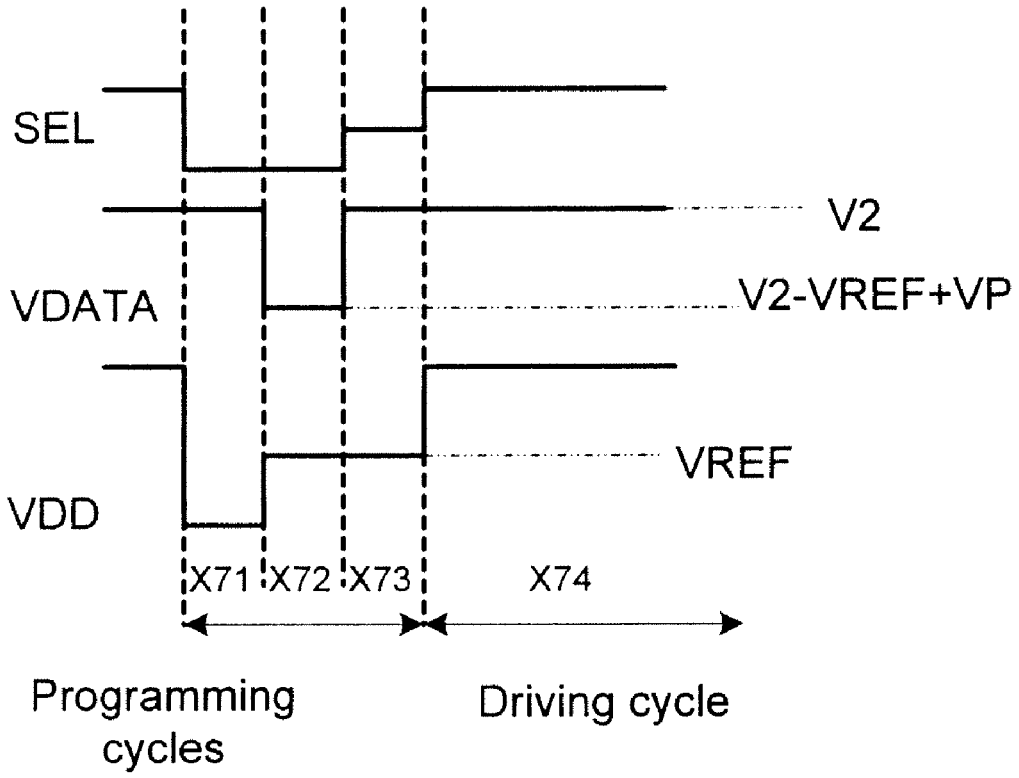
FIG. 20 is a timing diagram showing an example of waveforms for programming and driving the pixel circuit of FIG. 19.

FIG. 20 illustrates a timing diagram showing an example of waveforms for programming and driving the pixel circuit 212 of FIG. 19. FIG. 20 corresponds to FIG. 11. VDATA and VDD are used to programming and compensating for a time dependent parameter of the pixel circuit 212, which are similar to VDATA and VSS of FIG. 11. Referring to FIGS. 19 and 20, the operation of the pixel circuit 212 includes a programming cycle having four operating cycles X71, X72 and X73, and a driving cycle having one operating cycle X74.

During the programming cycle, a negative programming voltage plus the negative threshold voltage of the driving transistor 114 is stored in the storage capacitor 112. The storage capacitor 113 is discharged to zero.

As a result, the gate-source voltage of the driving transistor 114 goes to:

$$VGS=-VP-|VT| \quad (7)$$

where VGS represents the gate-source voltage of the driving transistor 114, VP represents the programming voltage, and VT represents the threshold voltage of the driving transistor 114.

In the first operating cycle X71: VDD goes to a negative voltage. SEL is low. Node A7 and node B7 are charged to a negative voltage.

In the second operating cycle X72: VDD goes to a reference voltage VREF. VDATA goes to (V2−VREF+VP). The voltage at node B7 and the voltage of node A7 are changed until the driving transistor 114 turns off. The voltage of B7 is (−VREF−VT), and the voltage stored in the storage capacitor 112 is (−VP−|VT|).

In the third operating cycle X73: SEL goes to VM. VM is an intermediate voltage in which the switch transistor 106 is off and the switch transistor 118 is on. VDATA goes to V2. The voltage of node C7 goes to V2. The voltage stored in the storage capacitor 112 is the same as that of X72.

In the fourth operating cycle X74: VDD goes to its operating voltage. SEL is high. The voltage stored in the storage capacitor 112 is applied to the gate of the driving transistor 114. The driving transistor 114 is on. Accordingly, a current independent of the threshold voltage VT of the driving transistor 114 and the voltage of the OLED 110 flows through the driving transistor 114 and the OLED 110.

FIG. 21 illustrates a pixel circuit 214 to which programming and driving technique in accordance with a further embodiment of the present invention is applied. The pixel circuit 214 includes an OLED 120, two storage capacitors 122 and 123, a driving transistor 124, and switch transistors 126 and 128. The pixel circuit 212 corresponds to the pixel circuit 206 of FIG. 12.

The transistors 124, 126 and 128 are p-type TFTs. The transistors 84 and 86 may be fabricated using amorphous silicon, nano/micro crystalline silicon, poly silicon, organic semiconductors technologies (e.g. organic TFT), CMOS technology (e.g. MOSFET) and any other technology which provides p-type transistors.

In FIG. 21, one of the terminals of the driving transistor 124 is connected to the anode electrode of the OLED 120, while the other terminal is connected to a voltage supply line VDD. The storage capacitors 122 and 123 are in series, and are connected between the gate terminal of the driving transistor 124 and VDD. The cathode electrode of the OLED 120 is connected to a controllable voltage supply electrode VSS.

The OLED 120 and the transistors 124 and 126 are connected at node A8. The storage capacitor 122 and the transistors 124 and 126 are connected at node B8. The transistor 128 and the storage capacitors 122 and 123 are connected at node C8.

Figure 22:
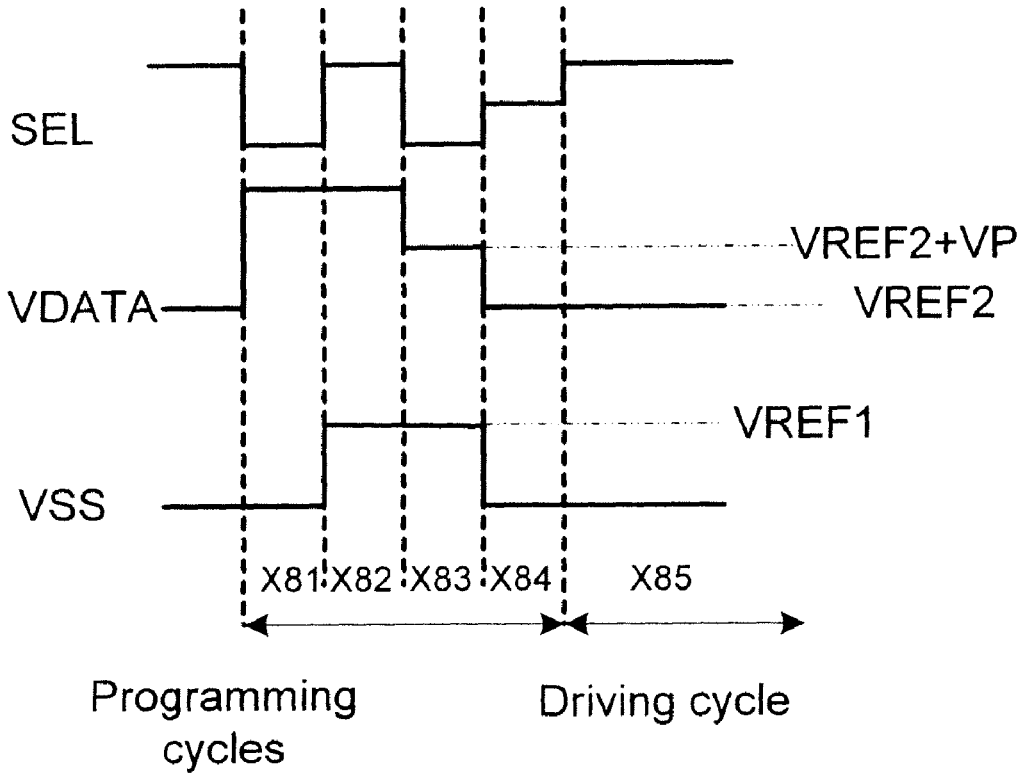
FIG. 22 is a timing diagram showing an example of waveforms for programming and driving the pixel circuit of FIG. 21.

FIG. 22 illustrates a timing diagram showing an example of waveforms for programming and driving the pixel circuit 214 of FIG. 21. FIG. 22 corresponds to FIG. 13. VDATA and VSS are used to programming and compensating for a time dependent parameter of the pixel circuit 214, which are similar to VDATA and VDD of FIG. 13. Referring to FIGS. 21 and 22, the programming of the pixel circuit 214 includes a programming cycle having four operating cycles X81, X82, X83 and X84, and a driving cycle having one driving cycle X85.

During the programming cycle, a negative programming voltage plus the negative threshold voltage of the driving transistor 124 is stored in the storage capacitor 122. The storage capacitor 123 is discharged to zero.

As a result, the gate-source voltage of the driving transistor 124 goes to:

$$VGS=-VP-|VT| \tag{8}$$

where VGS represents the gate-source voltage of the driving transistor 114, VP represents the programming voltage, and VT represents the threshold voltage of the driving transistor 124.

In the first operating cycle X81: VDATA goes to a high voltage. SEL is low. Node A8 and node B8 are charged to a positive voltage.

In the second operating cycle X82: SEL is high. VSS goes to a reference voltage VREF1 where the OLED 60 is off.

In the third operating cycle X83: VDATA goes to (VREF2+VP) where VREF2 is a reference voltage. SEL is low. Therefore, the voltage of node B8 and the voltage of node A8 become equal at the beginning of this cycle. It is noted that the first storage capacitor 112 is large enough so that its voltage becomes dominant. After that, node B8 is charged through the driving transistor 124 until the driving transistor 124 turns off. As a result, the voltage of node B8 is (VDD−|VT|). The voltage stored in the first storage capacitor 122 is (−VREF2−VP−|VT|).

In the fourth operating cycle X84: SEL goes to VM where VM is an intermediate voltage at which the switch transistor 126 is off and the switch transistor 128 is on. VDATA goes to VREF2. The voltage of node C8 goes to VREF2.

This results in that the gate-source voltage VGS of the driving transistor 124 is (−VP−|VT|). Since VM<−VP−VT, the switch transistor 126 is off, and the voltage stored in the storage capacitor 122 stays at −(VP+|VT↑).

In the fifth operating cycle X85: VSS goes to the operating voltage. SEL is low. The voltage stored in the storage capacitor 122 is applied to the gate of the driving transistor 124.

It is noted that a system for operating an array having the pixel circuit of FIG. 8, 10, 12, 17, 19 or 21 may be similar to that of FIG. 6 or 16. The array having the pixel circuit of FIG. 8, 10, 12, 17, 19 or 21 may have array structure shown in FIG. 7(*a*) or 7(*b*).

It is noted that each transistor can be replaced with p-type or n-type transistor based on concept of complementary circuits.

According to the embodiments of the present invention, the driving transistor is in saturation regime of operation. Thus, its current is defined mainly by its gate-source voltage VGS. As a result, the current of the driving transistor remains constant even if the OLED voltage changes since its gate-source voltage is stored in the storage capacitor.

According to the embodiments of the present invention, the overdrive voltage providing to a driving transistor is generated by applying a waveform independent of the threshold voltage of the driving transistor and/or the voltage of a light emitting diode voltage.

According to the embodiments of the present invention, a stable driving technique based on bootstrapping is provided (e.g. FIGS. 2-12 and 16-20).

The shift(s) of the characteristic(s) of a pixel element(s) (e.g. the threshold voltage shift of a driving transistor and the degradation of a light emitting device under prolonged display operation) is compensated for by voltage stored in a storage capacitor and applying it to the gate of the driving transistor. Thus, the pixel circuit can provide a stable current though the light emitting device without any effect of the shifts, which improves the display operating lifetime. Moreover, because of the circuit simplicity, it ensures higher product yield, lower fabrication cost and higher resolution than conventional pixel circuits.

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A method of programming a pixel circuit that drives a current-driven organic light emitting device independent of a threshold voltage of a drive transistor connected in series to the organic light emitting device, the pixel circuit further including a discharge transistor connected between the organic light emitting device and a node of the pixel circuit, the method comprising:

adjusting during a programming cycle a controllable voltage supply to a compensation voltage sufficient to turn off the organic light emitting device;

in a first operating cycle of the programming cycle, selecting a select line, to turn on a selection transistor coupled to the drive transistor, for applying a reference voltage to the drive transistor through the selection transistor;

in the first operating cycle, applying to a data line connected to the selection transistor a voltage that exceeds a programming voltage to be applied to the drive transistor;

responsive to the adjusting, allowing the node of the pixel circuit to charge or discharge through the drive transistor, via the discharge transistor, until the drive transistor turns off, thereby establishing the threshold voltage of the drive transistor across the drive transistor; and in a further operating cycle of the programming cycle following the first operating cycle, selecting the select line to turn on the selection transistor for applying a programming voltage from the data line to the drive transistor through the selection transistor, thereby establishing a fixed voltage applied to the drive transistor according to both the threshold voltage and the applied programming voltage, wherein the programming voltage is lower than the reference voltage.

2. The method of claim 1, further comprising:

setting the controllable voltage supply to an operating voltage; and deselecting the select line to complete the programming cycle and initiate a drive cycle during which the light emitting device is turned on according to the programming voltage while maintaining the fixed voltage on the drive transistor.

3. The method of claim 1, wherein the compensation voltage is sufficient to prevent the organic light emitting device from being turned on prior to the initiation of the drive cycle.

4. The method of claim 1, wherein the pixel circuit includes a storage capacitor coupled to the gate terminal of the drive transistor, and wherein the node of the pixel circuit is coupled to the gate terminal of the transistor such that the allowing the node of the pixel circuit to discharge is carried out by charging the storage capacitor through the discharge transistor and the drive transistor.

5. The method of claim 1, wherein a voltage stored on the node following the drive transistor turning off is different from the voltage on a voltage supply line connected to a terminal of the drive transistor opposite the organic light emitting device by the threshold voltage of the drive transistor.

6. The method of claim 1, wherein the select line remains selected during the allowing the node to charge or discharge and the applying the programming voltage.

7. The method of claim 1, wherein the selecting the select line is carried out by applying a first selection voltage on the select line, and wherein the select line is coupled to a gate of the discharge transistor such that selecting the select line with the first selection voltage turns on the discharge transistor to thereby allow the drive transistor to charge or discharge the node.

8. The method of claim 7, further comprising:

responsive to the applying the programming voltage, selecting the select line with a second selection voltage different from the first selection voltage, the second selection voltage being sufficient to turn on the selection transistor while turning off the discharge transistor; and applying a second reference voltage, via the data line, to allow the fixed voltage in the pixel circuit to be independent of the reference voltage.

9. The method of claim 8, wherein the pixel circuit includes a storage capacitor coupled between the selection transistor and the node of the pixel circuit for being charged with the fixed voltage, and a first capacitor coupled between a voltage supply line connected to the drive transistor opposite the light emitting device and the storage capacitor, the selection transistor connected to a node between the first capacitor and the storage capacitor, and wherein the applying the second reference voltage discharges the first capacitor and leaves the fixed voltage on the storage capacitor.

10. A display system comprising:

a pixel circuit including a drive transistor, a light emitting device, a switch transistor, and a discharge transistor, the drive transistor having a first terminal connected to the light-emitting device, the drive transistor having a threshold voltage that shifts during operation of the drive transistor, the switch transistor coupled between a data line and the discharge transistor, and the discharge transistor having a first terminal connected to the first terminal of the drive transistor and a second terminal connected to a gate terminal of the drive transistor, such that, during a compensation cycle of a programming cycle while the discharge transistor is selected via a select line and while a high voltage, which exceeds a programming voltage to be applied to the drive transistor through the switch transistor, is applied to the data line, the discharge transistor is allowed to charge or discharge a node of the pixel circuit, through the drive transistor, via the discharge transistor, until the drive transistor turns off, thereby establishing the threshold voltage of the drive transistor between the gate terminal and the first terminal of the drive transistor;

during an operating cycle of the programming cycle following the compensation cycle, turning on the switch transistor via the select line for applying the programming voltage from the data line to the drive transistor through the switch transistor, thereby establishing a fixed voltage applied to the drive transistor according to both the threshold voltage and the applied programming voltage, wherein the programming voltage is lower than the high voltage; and a controllable power supply connected to the light-emitting device for supplying the drive transistor with a voltage that is adjusted to a compensation voltage sufficient to turn off the light emitting device, during the compensation cycle.

11. The display system of claim 10 in which the controllable voltage source maintains a substantially constant pixel current as the threshold voltage of the drive transistor changes with the aging of the drive transistor.

12. The display system of claim 10 in which the light-emitting device includes an OLED supplied with the stable pixel current from the drive transistor, and the stable pixel current maintains a substantially constant brightness of the light emitted by the OLED.

13. The display system of claim 10 in which the light-emitting device pixel circuit includes an OLED having a voltage $V_{OLED}$ that increases as the OLED ages.

14. The display system of claim 10, wherein the pixel circuit is configured to receive, via the switch transistor, a reference voltage applied to a terminal of a storage capacitor, the storage capacitor being coupled to the gate terminal of the drive transistor such that the storage capacitor is charged according to the threshold voltage of the drive transistor during the compensation cycle.

15. The display system of claim 10, wherein the pixel circuit further includes:

a storage capacitor coupled to the gate terminal of the drive transistor, the storage capacitor adapted to apply a voltage to the drive transistor during a driving cycle of the pixel circuit during which the pixel circuit is operated to drive the light emitting device to emit light according to programming information, wherein the switch transistor is adapted to selectively couple the data line to the storage capacitor during the compensation cycle and during the programming cycle of the pixel circuit during which the pixel circuit receives the programming voltage according to the programming information.

16. The display system of claim 10 wherein the light-emitting device is an organic light emitting diode and the drive transistor is an n-type or p-type thin film transistor.

17. The display system of claim 10, wherein the node that is charged or discharged, via the discharge transistor, is directly connected to the gate terminal of the drive transistor.

* * * * *